US008023840B2

(12) United States Patent
Shirafuji

(10) Patent No.: US 8,023,840 B2
(45) Date of Patent: Sep. 20, 2011

(54) IMAGE FORMING APPARATUS FOR DETECTING THE DISTRIBUTION OF ELECTRICAL RESISTANCE OF A TRANSFERRING MEMBER

(75) Inventor: Yasuhito Shirafuji, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 427 days.

(21) Appl. No.: 12/201,215

(22) Filed: Aug. 29, 2008

(65) Prior Publication Data

US 2009/0067864 A1 Mar. 12, 2009

(30) Foreign Application Priority Data

Sep. 4, 2007 (JP) ..... 2007-229495

(51) Int. Cl.
*G03G 15/02* (2006.01)
*G03G 15/14* (2006.01)

(52) U.S. Cl. ..... 399/31
(58) Field of Classification Search ..... 399/31, 399/44, 66, 313; 39/66
See application file for complete search history.

(56) References Cited

U.S. PATENT DOCUMENTS

2004/0213594 A1* 10/2004 Takayanagi ..... 399/66
2007/0201888 A1* 8/2007 Izumi et al. ..... 399/44

FOREIGN PATENT DOCUMENTS

JP 2002-123124 4/2002

* cited by examiner

*Primary Examiner* — Quana M Grainger
(74) *Attorney, Agent, or Firm* — Fitzpatrick, Cella, Harper & Scinto

(57) ABSTRACT

An image forming apparatus includes a rotatable image bearing member and a toner image former for forming a toner image on the image bearing member, wherein the toner image former is capable of forming a toner image having a predetermined width measured in a direction of a rotational axis of the image bearing member at each of different positions, a transfer member, pressed against the image bearing member, for forming a transfer portion for transferring the toner image onto the transfer material from the image bearing member, a current detector for detecting a current flowing through the transfer member, a calculating portion for calculating a resistance difference in the transfer member with respect to the axial direction, on the basis of outputs of the current detector, for the toner images at the different positions when the toner images pass through the transfer portion, and an output portion for outputting an abnormality on the basis of an output of the calculating portion.

6 Claims, 18 Drawing Sheets

FIG. 21(a)
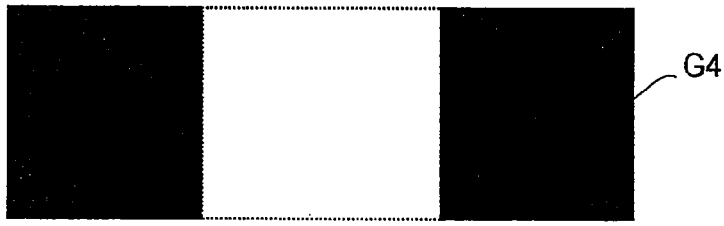
FIG. 21(b)
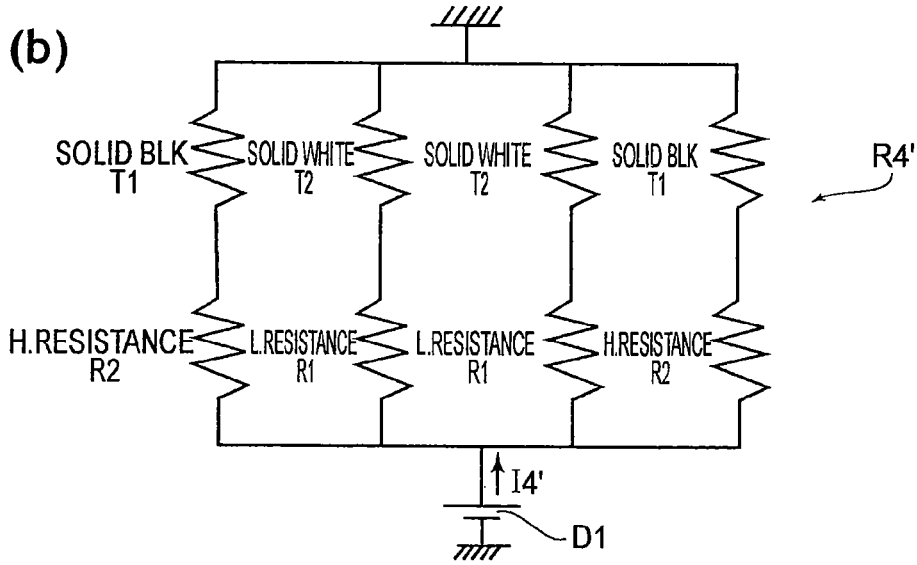
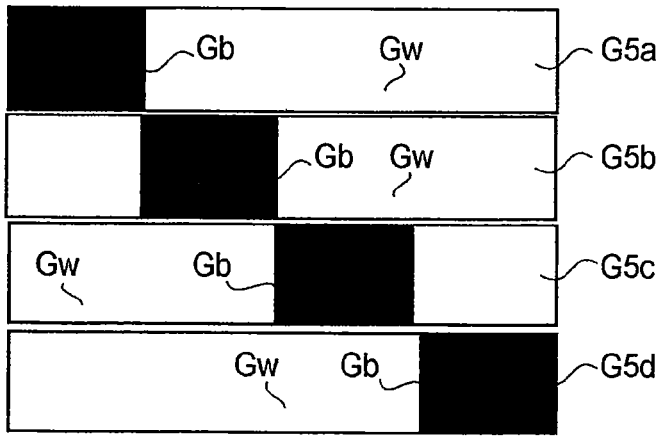
FIG.22

IMAGE FORMING APPARATUS FOR DETECTING THE DISTRIBUTION OF ELECTRICAL RESISTANCE OF A TRANSFERRING MEMBER

This application claims priority from Japanese Patent Application No. 2007-229495, filed Sep. 4, 2007, which is hereby incorporated by reference.

FIELD OF THE INVENTION AND RELATED ART

The present invention relates to an image forming apparatus, for example, a printer, a copying machine, a facsimile machine, a multifunction printer, etc., in particular, an image forming apparatus which transfers a toner image formed on its image bearing member onto a transferring member.

An image forming apparatus, which is designed to form an image on a transfer medium by transferring an image formed on its image bearing member, by conveying through its transferring portion between the image bearing member and its electrically resistive transferring member, while keeping the transfer medium pinched between the image bearing member and transferring member, has been put to practical use. Here, the image bearing member means a medium on which a toner image is directly formed, or an intermediary transferring member on which a toner image is indirectly formed. The transfer medium means an intermediary transfer medium, or a final recording medium.

A transferring member is made up of a metallic core and an electrically resistive layer. The metallic core is an electrically conductive member, which extends from one lengthwise end of the transferring member to the other. The electrically resistive layer is a cylindrical layer which covers virtually the entirety of the peripheral surface of the metallic core. The volume resistivity of the electrically resistive layer is in the range of $10^6\Omega$-$10^8\Omega$. In order to transfer a toner image onto a recording medium, a transfer voltage is applied to the transfer portion. As the transfer voltage is applied, a transfer current flows through the transfer portion. The amount of this current corresponds to the electrical resistance of the combination of the resistive layer and transfer medium, which are in serial connection to each other.

In recent years, in the field of a printing business, or the like, it has become a common practice to continuously print a large number of copies, which are identical. If a printer is used to continuously print a large number of identical copies, the transferring member of the printer is liable to become nonuniform in electrical resistance, in terms of its lengthwise direction. That is, usually, a brand-new transferring member is not nonuniform in electrical resistance in terms of its lengthwise direction. However, as it increases in the cumulative length of usage, it becomes gradually contaminated across certain areas. Thus, as the transfer member increases in the cumulative length of its usage, it gradually changes in physical properties. More specifically, as it increases in the cumulative length of its usage, it progressively becomes more nonuniform in electrical resistance in terms of its lengthwise direction (FIG. 14).

As a transferring member becomes nonuniform in electrical resistance in terms of its lengthwise direction, it begins to suffer from the problem that, even if the overall amount by which the transfer current flows through the transferring member is proper, the transfer current is nonuniform in density, in terms of the lengthwise direction of the transferring member, and the amount by which transfer current flows through a given point of the transferring member, in terms of the lengthwise direction of the transferring member, becomes different from that which flows through another point of the transferring member.

If an excessive amount of transfer current flows through a given portion of a transferring member, the toner particles in the portion of the transfer portion, which corresponds in position to the above-mentioned portion of the transferring member, are injected with an excessive amount of electrical charge, being thereby reversed in polarity. As the toner particles are reversed in polarity, they are transferred back onto the image bearing member. In other words, if the transferring member becomes nonuniform in electrical resistance in terms of its lengthwise direction, a so-called "excess current white spot" is likely to occur; the more nonuniform the transferring member, the more liable to occur the "excess current white spot".

On the other hand, the transfer current does not sufficiently flow through the portion of the transfer portion, which corresponds to the portion of the transferring member, which became higher in electrical resistance. In this portion of the transfer portion, therefore, some toner particles fail to be transferred, and remain on the image bearing member. That is, as the transferring member becomes nonuniform in electrical resistance, in terms of its lengthwise direction, a so-called "weak current white spot" is also liable to occur.

Thus, it is common practice to replace a transferring member as the cumulative length of its usage reaches a preset value, or the transfer error described above begins to frequently occur.

It was reported in Japanese Laid-open Patent Application 2002-123124 that the lengthwise nonuniformity, in electrical resistance, of the transferring member, in terms of its lengthwise direction, grew with the increase in the cumulative usage of the transferring member. Also reported in this patent application is that the amount of the electrical current which flowed through a given point of the transferring member, in terms of its lengthwise direction, was measured by moving a short electrode, which is in the form of a brush, along the transferring member in the direction parallel to the lengthwise direction of the transferring member, in contact with the transferring member, to obtain the distribution of the electrical resistance of the transferring member in terms of the its lengthwise direction, in order to evaluate the transferring member in its nonuniformity in electrical resistance in terms of the lengthwise direction of the transferring member.

The extent of the nonuniformity, in electrical resistance, of a transferring member in terms of its lengthwise direction is affected by the size and toner distribution of an image formed on an image bearing member, and the temperature and humidity of an environment in which an image forming apparatus is operated. Therefore, even if two transferring members are identical in physical properties when they are brand-new, and remain identical in the cumulative length of their usage, they become significantly different in the extent of nonuniformity in electrical resistance in terms of their lengthwise direction.

Thus, the practice of routinely replacing a transferring member for every preset cumulative length of its usage possibly creates a problem that, by the time the transferring member is to be replaced, the transferring member may have been continuously transferring toner images in an unsatisfactory manner, or a problem that, even if the transferring member in an image forming apparatus is almost as free from the nonuniformity in electrical resistance in terms of its lengthwise direction as a brand-new transferring member, it will be replaced anyway.

It is rather difficult, however, to find, in a small image forming apparatus, a space for an electrical resistance measuring apparatus, such as the one disclosed in Japanese Laid-open Patent Application No. 2002-123124, which moves an electrode, which is in the form of a brush, in the lengthwise direction of the transferring member.

SUMMARY OF THE INVENTION

Thus, the primary object of the present invention is to provide an electrical resistance detecting apparatus capable of easily detecting the distribution of the electrical resistance of a transferring member in terms of the lengthwise direction of the transferring member.

According to an aspect of the present invention, there is provided an image forming apparatus comprising a rotatable image bearing member toner image forming means for forming a toner image on the image bearing member, a transfer member, pressed against the image bearing member, for forming a transfer portion for transferring the toner image onto the transfer material from the image bearing member, a current detector for detecting a current flowing through the transfer member, wherein the toner image forming means is capable of forming a toner image having a predetermined width measured in a direction of a rotational axis of the image bearing member at each of different positions, a calculating portion for calculating a resistance difference in the transfer member with respect to the axial direction on the basis of outputs of the current detector for the toner images at the different positions when the toner images pass through the transfer portion, and an output portion for outputting an abnormality on the basis of an output of the calculating portion.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIGS. 21(*a*) and 21(*b*) are schematic drawings for describing the transfer current amount measuring second step when a test image G4 is used, in which FIG. 21(*a*) represents a test image and FIG. 21(*b*) represents an equivalent circuit of the transfer portion.

FIG. 22 is the drawing of the test image in the third embodiment.

DETAILED DESCRIPTION OF THE PREFERRED EMBODIMENTS

Hereinafter, the several preferred embodiments of the present invention will be described in detail with reference to the appended drawings. The following preferred embodiments of the present invention are not intended to limit the present invention in scope. That is, an image forming apparatus in accordance with the present invention is partially or entirely modifiable in structure, as long as the image forming apparatus resulting from the modification is capable of evaluating its transferring member in electrical resistance in terms of the lengthwise direction of the transferring member.

In other words, the present invention is also applicable to an image forming apparatus having multiple photosensitive drums disposed in contact with its intermediary transferring member or recording medium conveying member, and an image forming apparatus which directly transfers a toner image from its photosensitive drum(s) or photosensitive belt(s) onto a recording medium. Further, the present invention is also compatible with such a transferring means as a transfer belt that circularly rotates, although, in such a case, a lengthwise direction may be read as being a widthwise direction.

The following descriptions of the preferred embodiments primarily concern the portions of an image forming apparatus, which are essential to the formation and transfer of a toner image. However, the present invention is applicable to various image forming apparatuses, such as a personal printer, a commercial printer, a copying machine, a facsimile machine, a multifunction image forming apparatus, etc., which are made up of devices, equipment, housings (casings), etc., in addition to the above-mentioned portions.

Incidentally, the general items related to the image forming apparatus, its transferring member, etc., will not be illustrated, to avoid repeatedly describing the same items.

Embodiment 1

Figure 1:
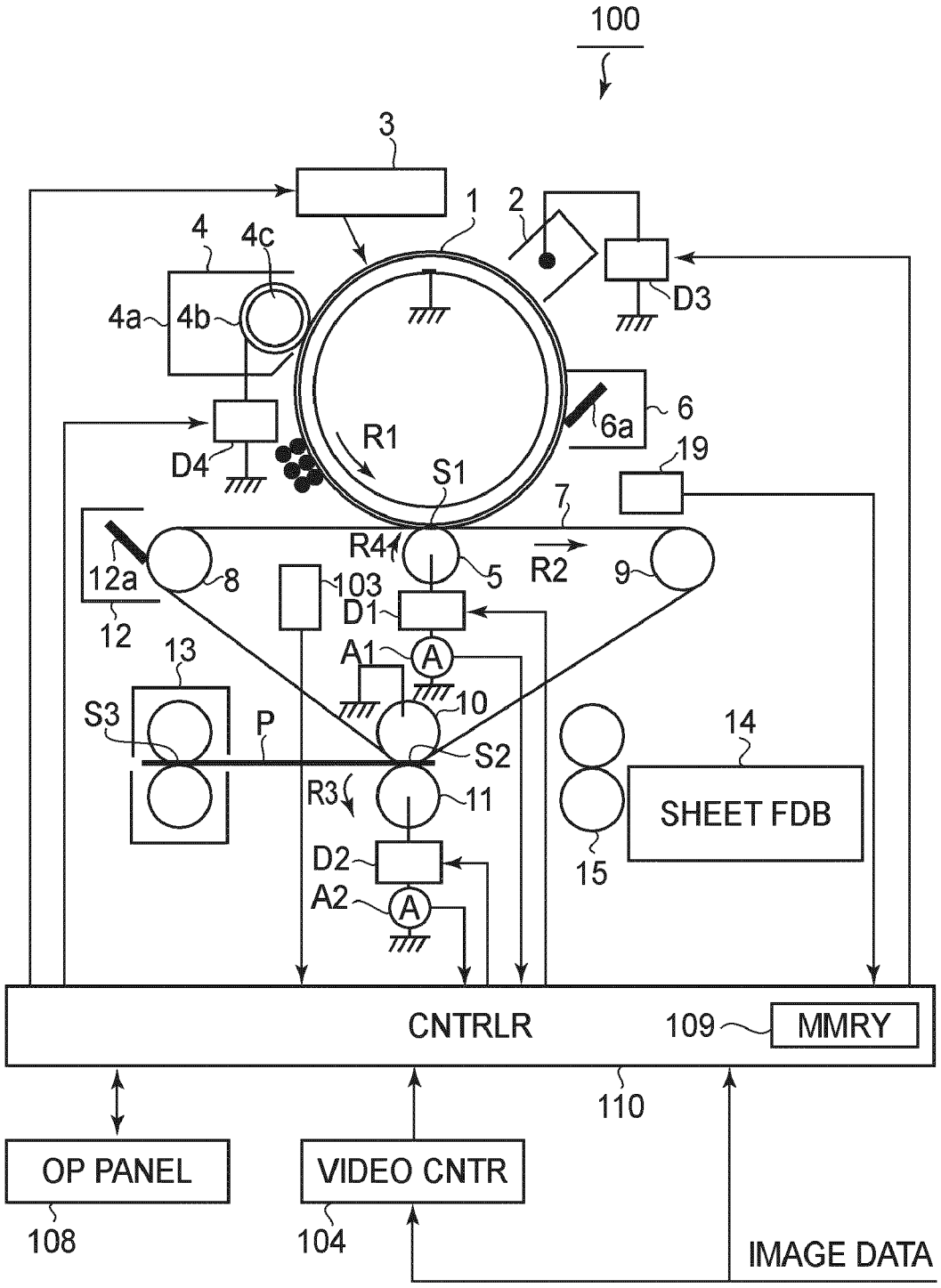
FIG. 1 is a drawing for describing the structure of the image forming apparatus in the first embodiment of the present invention.
Figure 2:
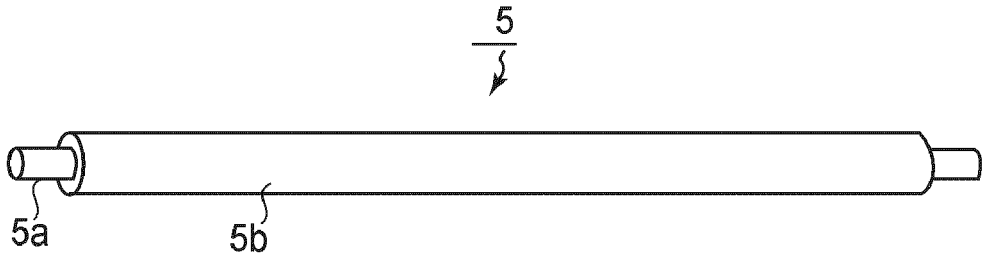
FIG. 2 is a perspective view of the primary transfer roller.
Figure 3:
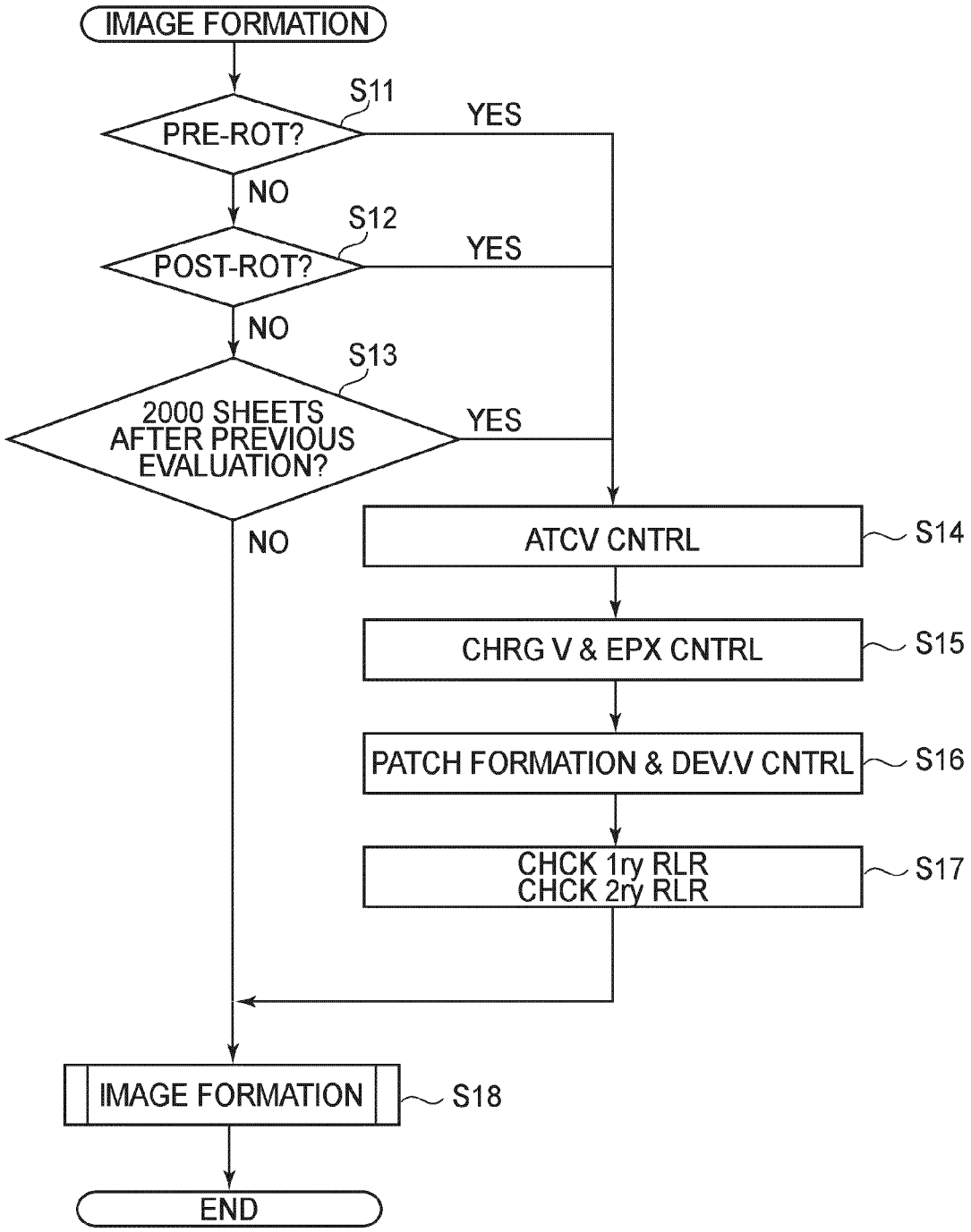
FIG. 3 is a flowchart of the transfer roller resistance evaluating portion of the image forming operation.

FIG. 1 is a schematic drawing of the image forming apparatus in the first embodiment of the present invention, and shows the general structure of the apparatus. FIG. 2 is a perspective view of the primary transfer roller of the image forming apparatus. FIG. 3 is a flowchart of the control sequence for the image forming operation of the image forming apparatus.

Referring to FIG. 1, the image forming apparatus 100 in the first embodiment is a monochromatic image forming apparatus. It has a photosensitive drum 1 and an intermediary transfer belt 7. The photosensitive drum 1 is horizontally disposed in contact with the intermediary transfer belt 7.

A toner image formed on the photosensitive drum 1, which is an image bearing member, is transferred (primary transfer) onto the intermediary transfer belt 7 in a transfer portion S1. Then, it is conveyed by the intermediary transfer belt 7 to a transfer portion S2, in which it is transferred (secondary transfer) onto a recording medium P.

The photosensitive drum 1 is rotationally driven. The image forming apparatus 100 has a charging apparatus 2, an exposing apparatus 3, a developing apparatus 4, a primary transfer roller, and a cleaning apparatus 6, which are disposed in the adjacencies of the photosensitive drum 1, in a manner to surround the peripheral surface of the photosensitive drum 1.

The photosensitive drum 1 is made up of a cylindrical substrate and a photosensitive layer. The substrate is formed of aluminum. The photosensitive layer is formed of amorphous silicon, which normally is chargeable to the positive polarity. The photosensitive layer covers virtually the entirety of the peripheral surface of the cylindrical substrate. The photosensitive drum 1 is 84 mm in external diameter, and 330 mm in length.

The photosensitive drum 1 is grounded through its substrate. It is rotationally driven by a motor (not shown) at a process speed of 300 mm/sec in the direction indicated by an arrow mark R1.

As the photosensitive drum 1 is rotated, the charging apparatus 2 uniformly charges the peripheral surface of the photosensitive drum 1 to roughly +500 V (dark potential level Vd). More specifically, the charging apparatus 2 discharges corona (collection of positively charged particles) in the adjacencies of the peripheral surface of the photosensitive drum 1. As a result, the peripheral surface of the photosensitive drum 1 becomes charged. An electrical power source D3 supplies the charging apparatus 2 with the positive voltage for discharging corona.

The exposing apparatus 3 scans the uniformly charged portion of the peripheral surface of the photosensitive drum 1, with the beam of laser light which it projects, while modulating the beam according to the image formation data. As a result, the numerous exposed points of the uniformly charged portion of the peripheral surface of the photosensitive drum 1 reduce in potential level to roughly +200 V (light potential level VL), effecting (writing) of an electrostatic image on the peripheral surface of the photosensitive drum 1.

More specifically, the exposing apparatus projects a beam of laser light by driving its laser light source, while modulating the beam of laser light with the image formation data obtained by developing the image data (turning on or off a laser light source according to image formation data). The projected beam of laser light is deflected by a rotational mirror in a manner to scan the peripheral surface of the photosensitive drum in the direction parallel to the axial line of the photosensitive drum.

The developing apparatus 4 has a developer container 4*a*, which contains black toner, which is a single component developer, which normally becomes charged to the negative polarity while it is stirred in the developer container 4*a*. The developing apparatus develops the electrostatic latent image formed on the peripheral surface of the photosensitive drum 1, and it causes the negatively charged toner to adhere to the latent image on the peripheral surface of the photosensitive drum 1.

The developing apparatus 4 has a development sleeve 4*b*, which is disposed so that there is a minute gap between its peripheral surface and the peripheral surface of the photosensitive drum 1. It is rotated in the opposite direction from the rotational direction of the photosensitive drum 1. As it is rotated, the black toner is borne in a thin layer on its peripheral surface of the development sleeve 4*b*. The developing apparatus 4 also has a stationary magnet 4*c*, which is disposed in the center of its hollow. As the development sleeve 4*b* is rotated, the black toner on the peripheral surface of the development sleeve 4*b* is made to crest by one of a magnetic pole of the magnet 4*c*, rubbing therefore, the peripheral surface of the photosensitive drum 1.

An electrical power source D4 outputs to the development sleeve 4*b* the combination of a development voltage Vdc, which is roughly +300 V of DC voltage, and an AC voltage, which is 1.2 k Vpp in peak-to-peak voltage and 3 kHz in frequency. As the combination is applied to the development sleeve 4*b*, the black toner selectively adheres to the electrostatic image on the peripheral surface of the photosensitive drum 1, the black toner adheres to the numerous points of the peripheral surface of the photosensitive drum 1, the potential level of which has reduced to a dark potential level Vd, which is positive relative to the development voltage Vdc. In other words, the electrostatic latent image is normally developed. The black developer does not adhere to the points of the peripheral surface of the photosensitive drum 1, the potential level of which was made negative relative to the development voltage Vdc by the exposure.

As will be evident from the description given above, the exposing apparatus, charging apparatus, and developing apparatus make up a toner image forming means, which forms a toner image on the peripheral surface of the photosensitive drum 1.

The intermediary transfer belt 7 is an endless belt. It is supported by a driver roller 8, a tension roller 9, and a backup roller 10, by being stretched around them. It is rotationally driven by the driver roller 8 at a process speed of 300 mm/sec. However, there is roughly ±0.5% of a difference ΔV between the referential (preset) process speed of 300 mm/sec and those of the intermediary transfer belt 7 and photosensitive drum 1.

The intermediary transfer belt 7 is formed of an electrically resistive substance, more specifically, a mixture of polyimide resin, and a charge prevention agent, such as carbon black, which is dispersed in polyimide resin to adjust the volume resistivity of the mixture to a value in a range of $10^6$-$10^{10}$ Ω·cm. The intermediary transfer belt 7 is roughly 0.1 mm in thickness and 600 mm in circumference.

The primary transfer roller 5 (transferring member) is kept pressed against the photosensitive drum 1 by a pair of springs (not shown), which press on the lengthwise ends of the transfer roller 5, with the intermediary transfer belt 7 pinched between the primary transfer roller 5 and photosensitive drum 1, forming thereby the transfer portion S1, in which the toner image is transferred onto the intermediary transfer belt 7. The primary transfer roller 5 is rotated in the direction indicated by an arrow mark R4 by the circular movement of the intermediary transfer belt 7, upon which it is kept pressed.

An electrical power source D1 transfers (primary transfer) the toner image formed and borne on the photosensitive drum 1, onto the intermediary transfer belt 7 by applying a transfer voltage V1, which is a positive DC voltage, between the grounded photosensitive drum 1 and primary transfer roller 5.

The transfer current, which flows through the transfer portion S1 as the transfer voltage V1 is applied thereto, separates the toner image from the photosensitive drum 1, and electrostatically adheres to the portion of the intermediary transfer belt 7, which is being moved through the transfer portion S1, while remaining pinched between the primary transfer roller 5 and photosensitive drum 1.

Referring to FIG. 2, the primary transfer roller 5 is made up of a metallic core 5*a* and an elastic layer 5*b*. The metallic core 5*a* is made of stainless steel, and is 8 mm in diameter. The elastic layer 5*b* is formed of electrically conductive urethane sponge, covering virtually the entirety of the peripheral surface of the metallic core 5*a*, and is 4 mm in thickness and 300 mm in length. The primary transfer roller 5 is roughly $1\times10^7$Ω·cm (23° C., 50% RH) in electrical resistance. The resistance value was obtained by measuring the amount of electrical current, which flowed when a voltage of 1,500 V was applied between a metallic roller and the metallic core 5*a*, while the primary transfer roller 5 is rotated in contact with the metallic roller by the rotation of the metallic roller at a peripheral velocity of 300 mm/sec, with the presence of a contact pressure of 5 N (500 gf).

Referring to FIG. 1, the cleaning apparatus 6 has a cleaning blade 6*a*, which is placed in contact with the peripheral surface of the photosensitive drum 1, in such a manner that its cleaning edge is on the upstream side of its base portion in terms of the rotational direction of the photosensitive drum 1. The cleaning apparatus 6 (cleaning blade 6*a*) removes the transfer residual toner, that is, the toner remaining on the peripheral surface of the photosensitive drum 1 after being moved through the transfer portion S1, by rubbing (scraping) the peripheral surface of the photosensitive drum 1.

The secondary transfer roller 11 is kept pressed against the backup roller 10 by being pressed by a pair of springs upon its lengthwise ends, one for one, with the presence of the intermediary transfer belt 7 between the secondary transfer roller 11 and backup roller 10. It forms the transfer portion S2 between the intermediary transfer belt 7 and secondary transfer roller 11.

The secondary transfer roller 11 (transferring member) is made up of a metallic core and an elastic layer. The metallic core is formed of stainless steel, and is 12 mm in diameter. The elastic layer is formed of electrically conductive urethane sponge, covering virtually the entirety of the peripheral surface of the metallic core. The elastic layer is 6 mm in thickness and 330 mm in length.

The electrical resistance value of the secondary transfer roller 11 was measured with the use of a method similar to the method used for measuring the electrical resistance value of the primary transfer roller 5. When it was measured with the application of 3,000 V, it was roughly $6\times10^7$Ω·cm (23° C., 50% RH).

An electrical power source D2 transfers (secondary transfer) the toner image borne on the intermediary transfer belt 7, onto the recording medium P by applying a transfer voltage V2, which is a positive DC voltage, between the grounded backup roller 10, and the secondary transfer roller 11. The transfer current, which flows through the transfer portion S2 while the transfer voltage V2 is applied to the secondary transfer roller 11, supplies the toner image with the transfer charge, separating thereby the toner image from the intermediary transfer belt 7, so that the toner image electrostatically adheres to the portion of the recording medium P, which is being conveyed through the transfer portion S2, while remaining pinched between the intermediary transfer belt 7 and secondary transfer roller 11.

The recording mediums P are pulled out one by one from a sheet feeding apparatus 14, and delivered to a pair of registration rollers 15. As each recording medium P reaches the pair of registration rollers 15, it is kept on standby by the registration rollers 15, and then, is released by the registration rollers 15, to be fed into the transfer portion S2 in synchronism with the arrival of the toner image on the intermediary transfer belt 7 at the transfer portion S2. As the recording medium P arrives at the transfer portion S2, it is conveyed through the transfer portion S2 while remaining pinched between the secondary transfer roller 11 and intermediary transfer belt 7.

The cleaning apparatus 12 has a cleaning blade 12*a*, which is placed in contact with the intermediary transfer belt 7 in such a manner that its cleaning edge is on the upstream side of its base portion, in terms of the rotational direction of the intermediary transfer belt 7. The cleaning apparatus 12 (cleaning blade 12*a*) removes the transfer residual toner, that is, the toner remaining on the intermediary transfer belt 7 after being moved through the transfer portion S2, by rubbing (scraping) the intermediary transfer belt 7.

After the toner image was transferred (secondary transfer) onto the recording medium P, while it was conveyed through the transfer portion S2, the recording medium P is conveyed to the fixing apparatus 13, through which the recording medium P is conveyed through the fixing portion S3 of the fixing apparatus, while remaining pinched between the two rollers of the fixing apparatus 13. While the recording medium P is conveyed through the fixing portion S3, it is subjected to heat and pressure. As a result, the toner image on the recording medium P is welded (fixed) to the surface of the recording medium P.

An image density sensor 19 detects the density of the toner image on the intermediary transfer belt 7 by measuring the reflected amount of the infrared light which it projects upon the toner image, and then, outputs a signal which reflects the measured density of the toner image to a control portion 110.

A temperature-humidity sensor 103 detects the ambient temperature and humidity of the photosensitive drum 1 and developing apparatus 4, and outputs signals (analog voltages), which reflect the detected values of temperature and humidity, to the control portion 110.

A control panel is in the form of a touch sensitive liquid crystal display. An operator can make the control panel 108 display various information by inputting required information into the control portion 110 through the control panel 108.

Referring to FIG. 3, as well as FIG. 1, the control portion 110 carries out steps S14-S17 if it is immediately after the pre-rotation (YES in S11), immediately after the post-rotation (YES in S12), or immediately after a two hundredth copy was made since the last evaluation of the primary transfer roller 5, or the like, in nonuniformity in electrical resistance (YES in S13).

The control portion 110 optimizes the transfer portions S1 and S2 in transfer efficiency by setting values for the transfer voltage V1 and transfer voltage V2 by carrying out an Active Transfer Voltage Control (ATVC) sequence, which will be described later.

After the setting of the transfer voltages V1 and V2, the control portion 110 sets the values for the parameters for the formation of an electrostatic image (S15), and the values for the parameters for the development of the electrostatic latent image (S16), so that the density level at which a toner image formed on the photosensitive drum 1 converges to a preset value.

After setting the values for the electrostatic image formation parameters and electrostatic latent image development parameters, the control portion 110 calculates the amount (extent) of the electrical resistance nonuniformity of the first and second transfer rollers 5 and 11 in terms of their lengthwise direction, by functioning as a calculating portion (S17).

Then, the control portion 110 determines whether or not the calculated extent of the electrical resistance nonuniformity of the first and second transfer rollers 5 and 11 is within a tolerable range. If the calculated extent of the electrical resistance uniformity is beyond the tolerable range, the control portion 110 interrupts the image forming operation, and displays across the control panel 108 a message which prompts the operator to replace the unsatisfactory roller(s), by functioning as an information outputting means.

If it is not immediately after the pre-rotation, immediately after the post-rotation, or immediately after the two hundredth copy has just been made, since the last evaluation of the electrical resistance nonuniformity of the primary transfer roller 5, or the like (No in S13), the control portion 110 carries out the image formation (S18). It is also as soon as the steps S14-S17 are completed, that the control portion 110 carries out the image forming operation (S18).

<Setting of Constant Voltage>

Figure 4:
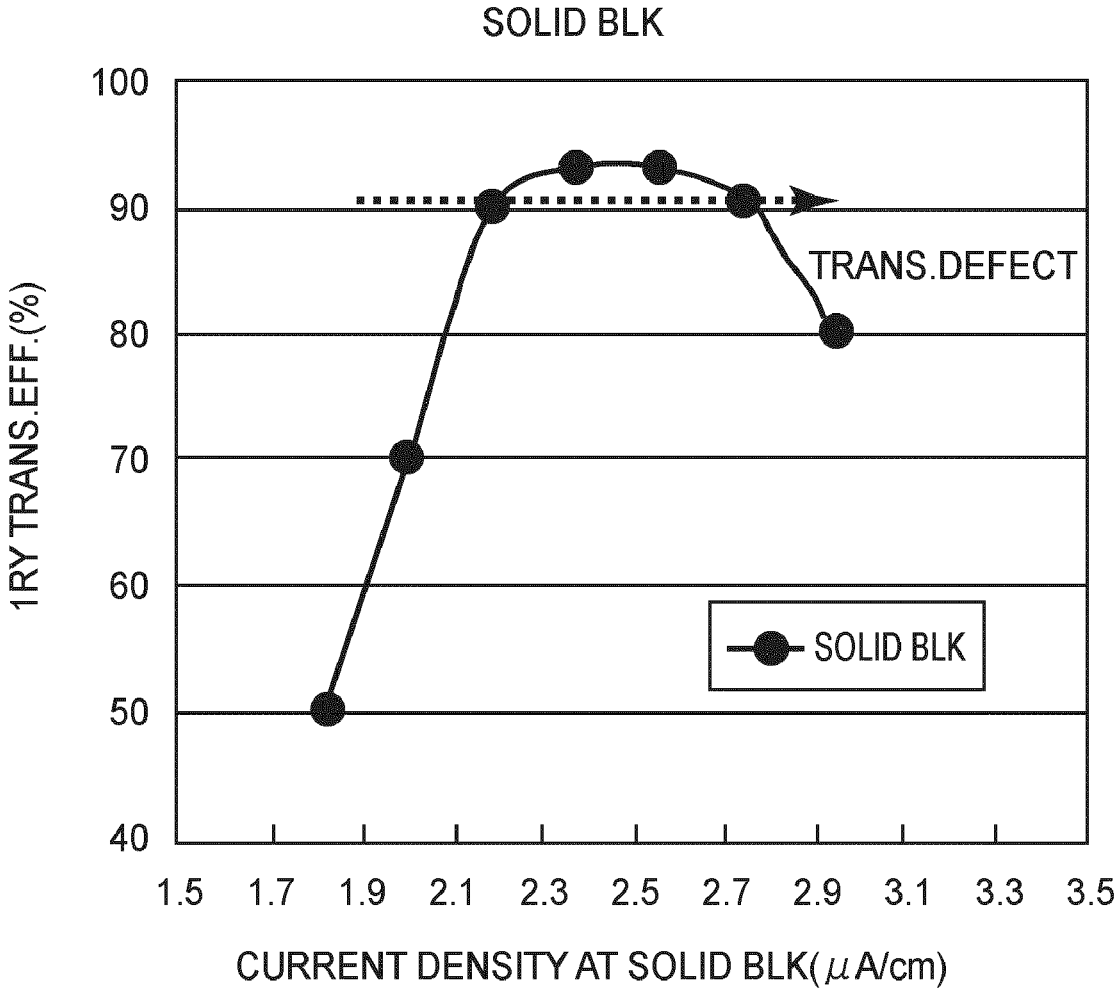
FIG. 4 is a graph showing the relationship between the transfer current and transfer efficiency.
Figure 5:
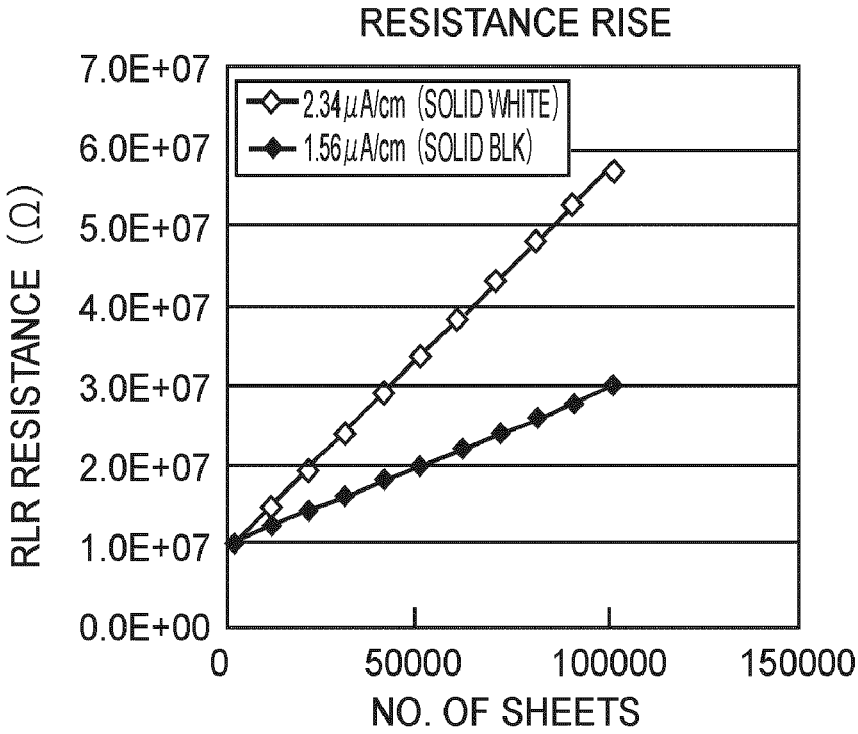
FIG. 5 is a graph showing the relationship between the amount of electrical resistance of the primary transfer roller, and the cumulative number of copies of a solid white image formed continuously by the image forming apparatus, while keeping constant the transfer voltage, and the relationship between the amount of electrical resistance of the primary transfer roller, and cumulative number of copies of a solid black image formed continuously by the image forming apparatus, while keeping constant the transfer voltage.
Figure 6:
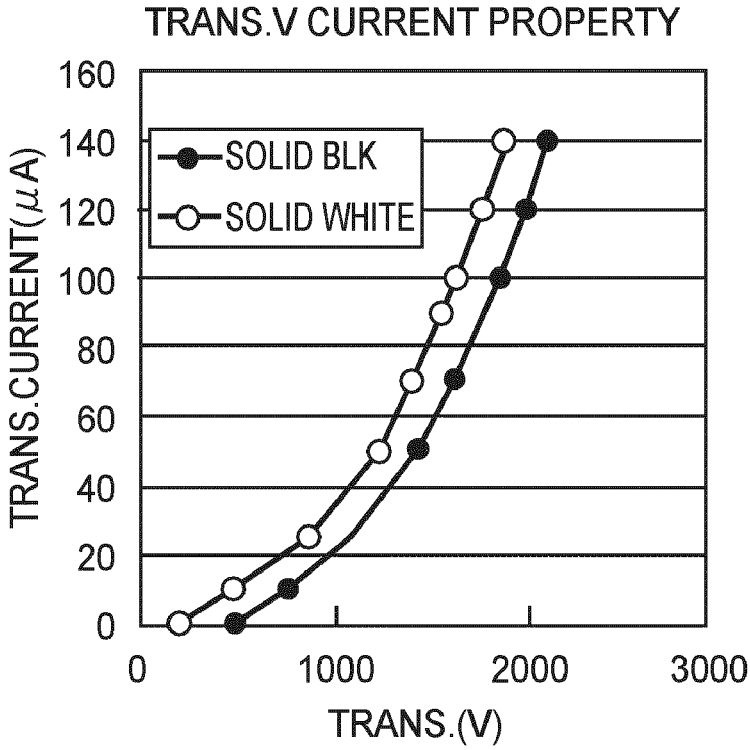
FIG. 6 is a graph showing the relationship between the amount of constant transfer voltage applied to transfer (primary transfer) a solid white image, and the amount of the corresponding transfer current, and the relationship between the amount of constant transfer voltage applied to transfer (primary transfer) a solid black image, and the amount of the corresponding transfer current.

FIG. 4 is a graph showing the relationship between the transfer current and transfer efficiency. FIG. 5 is a graph showing the changes in the electrical resistance value of the primary transfer roller, which occurred as a substantial number of copies of a solid white image were continuously made, while keeping constant the transfer voltage, and the changes in the electrical resistance of the primary transfer roller, which occurred when a substantial number of copies of a solid black image were continuously made, while keeping constant the transfer voltage. FIG. 6 is a graph showing the relationship between the amount of constant voltage applied to transfer (primary transfer) a solid white image, and the amount of the corresponding transfer current, and the relationship between the amount of constant voltage applied to transfer (primary transfer) a solid black image, and the amount of the corresponding transfer current.

Hereafter, in order to avoid a repetition of the same description, only the setting of the constant voltage to be applied to the primary transfer roller 5 will be described. The steps to be taken to set the value for the constant voltage to be applied to the secondary transfer roller 11 are the same as the steps to be taken to set the values for the primary transfer roller 5.

Referring to FIG. 4, as well as FIG. 1, the transfer efficiency of the transfer portion S1 is highest when the current density of the primary transfer roller 5 per unit length in terms of the lengthwise direction of the transfer portion S1 is within a specific range. FIG. 4, however, shows the relationship between the transfer current and transfer efficiency, in the first embodiment, when the image forming apparatus 100 was operated under a specific condition. In other words, the range in which the current density is highest is affected by the temperature and humidity of the environment in which the image forming apparatus 100 is operated, and the electrical properties of the toner.

Referring to FIG. 4, in the left portion of the graph, more specifically, when the transfer current density is below the range above which the transfer efficiency is in the highest range, it is impossible to transfer all the negatively charged toner particles on the photosensitive drum 1 so that a so-called "weak current white spot" is liable to occur.

In the portion of the graph, more specifically, when the transfer efficiency is also below the range above which the transfer efficiency is in the highest range, an electrical charge is injected into the toner particles, reversing the toner particles in polarity. Thus, the toner particles having just been transferred onto the intermediary transfer belt 7 transfer back onto the photosensitive drum 1 from the intermediary transfer belt 7, in response to the transfer voltage V1. That is, a so-called "strong current white spot" is liable to occur.

Next, referring to FIG. 5, which shows the results of the test in which 100,000 copies of a solid white image and 100,000 copies of a solid black image were continuously made, while applying +1,500 V of constant voltage to the primary transfer roller 5, as well as FIG. 1, the resistance value of the primary transfer roller 5 gradually increased with the increase in the cumulative number of copies made. Further, the resistance value of the primary transfer roller 5 increased faster when 100,000 copies of a solid white image were continuously made than when the 100,000 copies of a solid black image were continuously made.

The reason for the occurrence of the phenomenon described above is as follows: When a solid black image is transferred, the electrical resistance value of the transfer portion S1 is higher by the resistance value of the toner layer, and therefore, the electrical current, which flows through the elastic layer (5*b* in FIG. 2) of the primary transfer roller 5, is lower in density, than when a solid white image is transferred. When the first solid black image was transferred in the transfer portion S1 while applying +1,500 V of constant transfer voltage, the current density was 1.56 μA, whereas when the first solid white image was transferred in the transfer portion S1 while applying +1,500 V of constant transfer voltage, the current density was 2.34 μA.

The primary transfer roller 5 in the first embodiment is made up of a rubber sponge, which is capable of conducting ions. Therefore, as electrical current flows through the primary transfer roller 5, the primary transfer roller 5 becomes nonuniform in ion distribution, increasing thereby in electrical resistance. The rate of this increase in the electrical resistance of the primary transfer roller 5 is greatly affected by the density of the electrical current that flows into the primary transfer roller 5, and the cumulative amount of electrical current that flows into the primary transfer roller 5.

Referring to FIG. 6, which shows the results of the test in which the amount of the transfer current which flowed through the transfer portion S1 when a solid white image was transferred by applying 0-2,200 V of constant voltages to the primary transfer roller 5, and when a solid black image was transferred by applying 0-2,200 V of constant voltage to the primary transfer roller 5, as well as FIG. 1, the amount of constant voltage necessary to make a given amount of transfer current flow when transferring a solid black image was higher by 200 V-300 V than the amount of constant voltage necessary to make the same amount of transfer current to flow when transferring a solid white image.

The reason for the above-described phenomenon is as follows: When a solid black image is transferred, the electrical resistance value of the transfer portion S1 is higher, by the amount of the electrical resistance of the toner layer, than when a solid white image is transferred. Therefore, in order to make the same amount of electrical current as the amount of current that flows through the transfer portion S1 when a solid white image is transferred, when a solid black image is transferred in the transfer portion S1, the constant voltage to be applied to the primary transfer roller 5 to transfer a solid black image must be higher than the amount of constant voltage to be applied to the primary transfer roller 5 to transfer a solid white image.

Further, one of the electrical properties of the electrically conductive urethane sponge used as one of the materials for the elastic layer (5*b* in FIG. 2) of the primary transfer roller 5 is that as electrical current continuously flows through the urethane sponge in the same direction, the urethane sponge increases in electrical resistance.

Therefore, in a case when the transfer voltage applied to the primary transfer roller 5 is kept constant, if the electrical resistance of the primary transfer roller 5 increases, the amount by which electrical current flows into the transfer portion S1 through the primary transfer roller 5 reduces, making it impossible to maintain the current density at the necessary level shown in FIG. 4.

Therefore, during the periods in which no image is formed, the control portion 110 sets the constant transfer voltage V1 by carrying out the ATVC (Active Transfer Voltage Control) sequence. The periods in which no image is formed are the pre-rotation period, that is, the period in which the image forming apparatus 100 is started up, the post-rotation period, that is, the period from the formation of the last copy to when the image forming apparatus 100 is turned off, and the period right after the image forming operation is suspended, because the cumulative number of copies made since the last setting of the constant voltage by the control portion 110 has reached a preset value.

Referring to FIG. 5, which shows the relationship among the cumulative number of copies made and the increase in the electrical resistance of the primary transfer roller 5, which are the factors involved in the ATVC, the resistance value of the primary transfer roller 5 continuously rises even during the continuous formation of two hundred copies. However, as long as the amount of increase in the electrical resistance of the primary transfer roller 5 is roughly equivalent to two hundred copies, it does not occur that the transfer efficiency deviates far enough from the range in which it is highest, to cause a toner image to be unsatisfactorily transferred.

The ATVC sequence to be carried out by the control portion 110 is as follows: The control portion 110 applies multiple voltages, which are different in magnitude, by controlling the power source D1, and measures the amount of the current which flows into the primary transfer roller 5 at each voltage level, through a current detection circuit A1.

Then, the control portion 110 obtains the proper value for the constant voltage to be applied to make a target amount (50 μA) of current flow, based on the data regarding the relationship between the constant voltage applied to the primary transfer roller 5, and the amount of transfer current caused to flow by the constant voltage. Then, the control portion 110 controls the power source D1 to output to the primary transfer roller 5 a constant voltage of the obtained value. For example, if the amount of transfer current detected when +1,400 V of constant voltage was applied was 45 μA, and the amount of transfer current detected when +1,600 V of constant voltage was applied was 55 μA, the control portion 110 sets the value for the constant voltage to be applied during an image formation, to +1,500 V.

Then, the control portion 110 selects the target value for the transfer current, which corresponds to the ambient temperature and humidity of the developing apparatus, from one of the tables in a data storage apparatus 109, based on the output of the temperature-humidity sensor 103.

Here, for descriptive convenience, it is assumed that the selected target value for the transfer current, which corresponded to ambient temperature and humidity of 23° C. and 50% RH, respectively, was 50 μA, and the value for the constant voltage to be applied to the primary transfer roller 5, which corresponded to the target value 50 μA for the transfer current, was set to +1,500 V.

The constant voltage, which is to be applied to the secondary transfer roller 11 during an image forming operation, is also set through an ATVC sequence, similar to that used for setting the constant voltage to be applied to the primary transfer roller 5. Here, it is assumed that the constant voltage was set to +300 V to so that 50 μA (target amount) of transfer current would flow.

<Setting of Electrostatic Image Formation Parameters and Electrostatic Latent Image Development Parameters>

After the completion of the ATVC sequence, the parameters for electrostatic image formation were set. That is, first, the voltage level for the image area (dark potential level Vd) was set to roughly +500 V. Then, the light potential level VL (which corresponds to points of peripheral surface of photosensitive drum 1, to which no toner is to be adhered, corresponds to solid white areas) was set to roughly +200 V.

Then, the control portion 110 forms on the photosensitive drum 1 an electrostatic latent image, which corresponds to a test patch, using the values set for the electrostatic latent image formation parameters. Then, it forms an image of the test patch (test patch image formed of toner) on the photosensitive drum 1 by developing the electrostatic latent image on the photosensitive drum 1, using the last set of values for the development parameters. Then, it transfers (primary transfer) the toner image of the test patch from the photosensitive drum 1 onto the intermediary transfer belt 7 by applying the constant voltage set through the ATVC sequence, to the primary transfer roller 5. Then, it measures the density of the toner image of the test patch on the intermediary transfer belt 7 by the image density sensor 19.

Next, the control portion 110 adjusts the power source D4 in output, that is, the DC voltage Vdc to be outputted to the development sleeve 4*b* by the power source D4. More specifically, if the toner image of the test patch was excessively high in density, the control portion 110 reduces the density level at which toner adheres to the photosensitive drum 1, by reducing the DC voltage Vdc, whereas if the toner image of the test patch was excessively low in density, the control portion 110 increases the density level at which toner adheres to the photosensitive drum 1, by increasing the DC voltage Vdc.

With the employment of the above-described control, the amount, per unit area, by which toner is deposited on the photosensitive drum 1, to form a toner image, converges to a preset referential value. Therefore, the value of the electrical resistance of the toner layer (toner image), per unit length of the toner layer in terms of the lengthwise direction of the transfer portion S1, converges to a preset referential value.

In the first embodiment, it is assumed that the development voltage Vdc to be applied to the development sleeve 4*b* was set to +300 V, and the AC voltage to be applied to the development sleeve 4*b* in combination with the development voltage Vdc was set to 1.2 kVpp in peak-to-peak voltage and 3 kHz in frequency.

<Sequence for Evaluating Primary Transfer Roller in Nonuniformity in Electrical Resistance>

Figure 7:
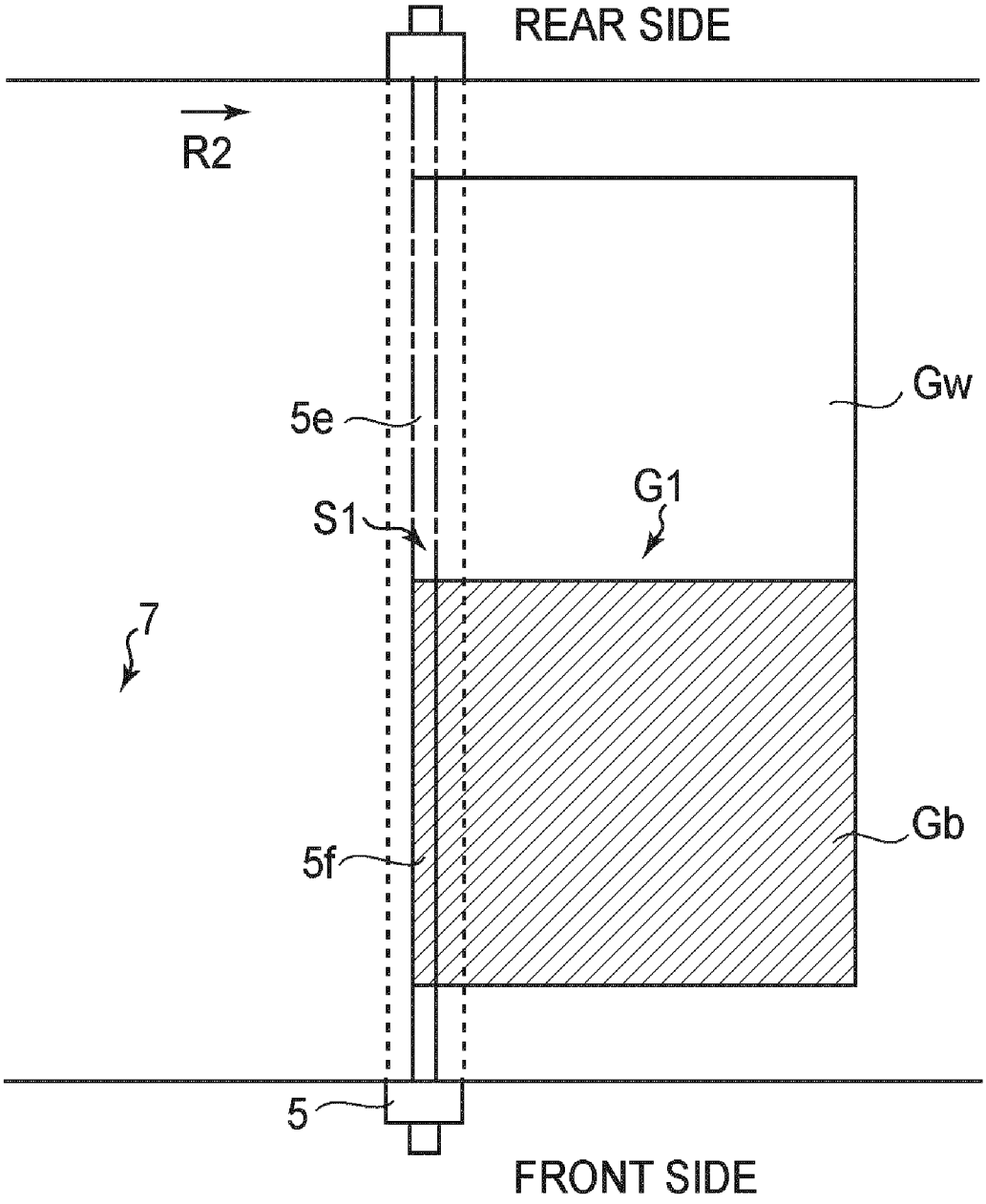
FIG. 7 is a schematic drawing for describing the primary transfer of a test image.
Figure 8:
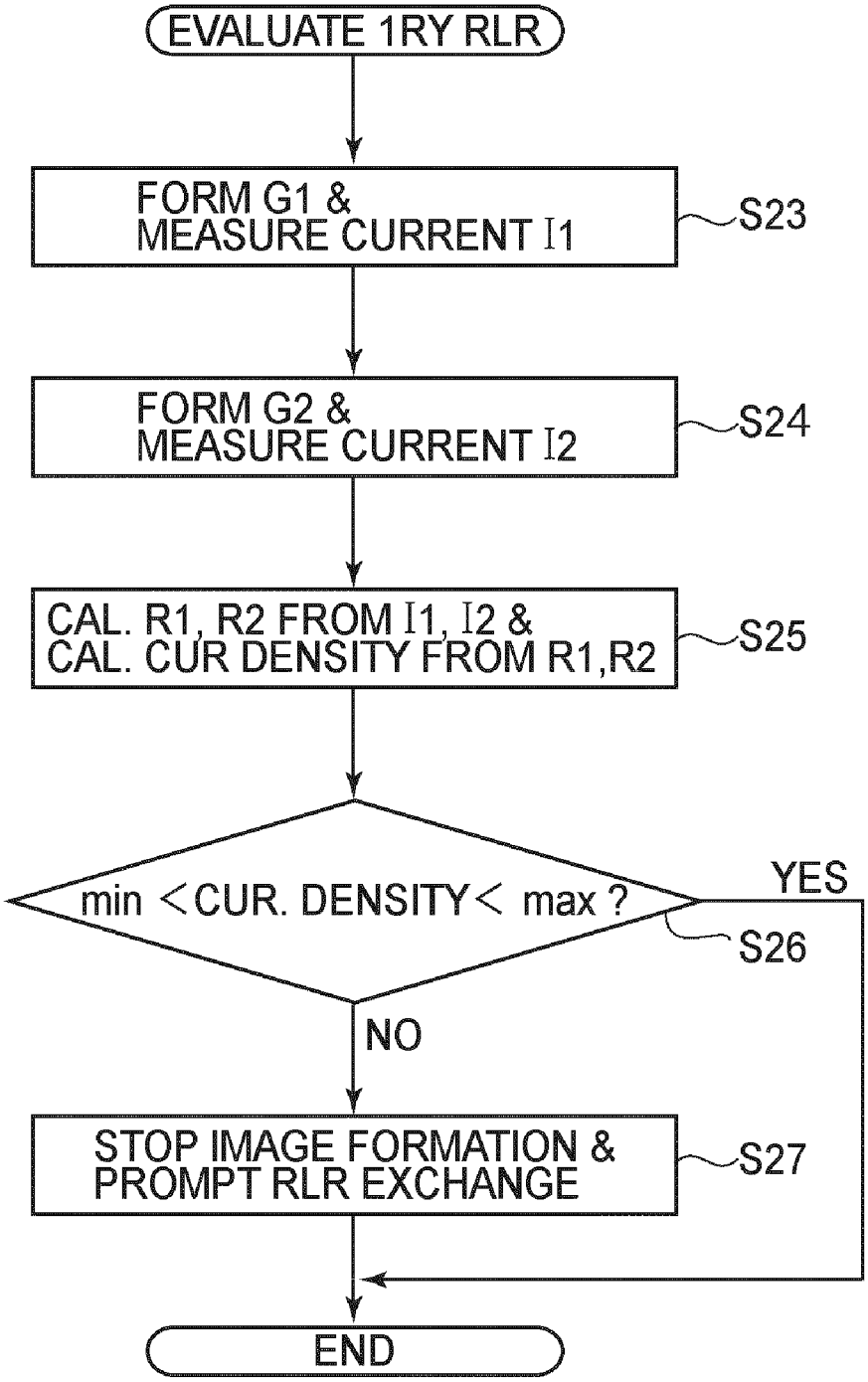
FIG. 8 is a flowchart of an operational sequence for evaluating the primary transfer roller in the nonuniformity in electrical resistance.
Figure 9:
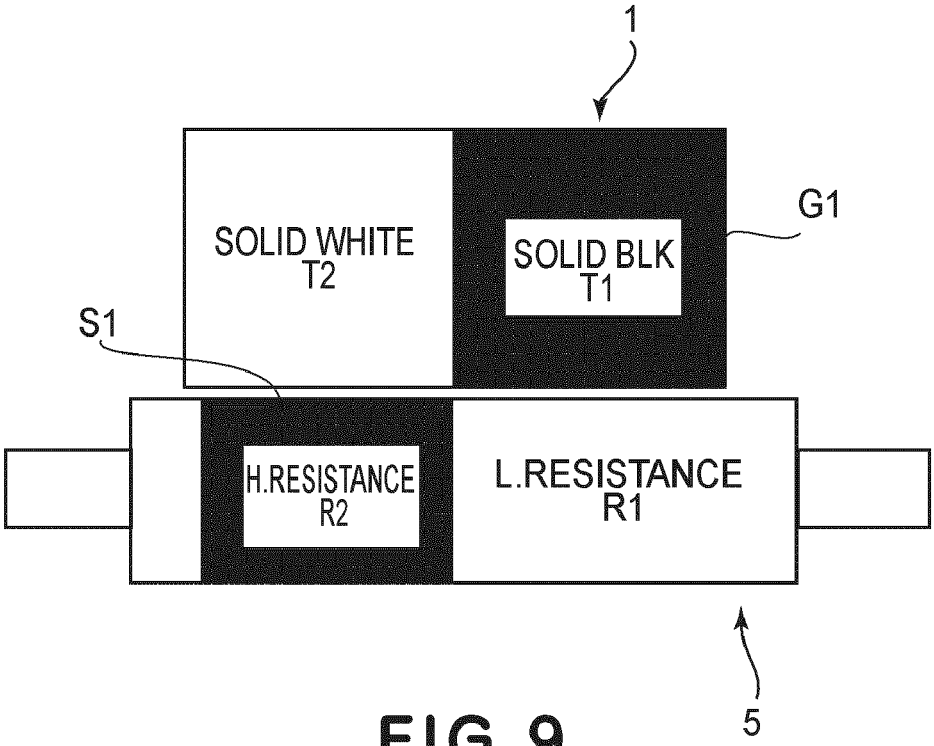
FIG. 9 is a schematic drawing for describing the transfer current amount measuring first step, that is, a step in which a test image G1 was used.
Figure 10:
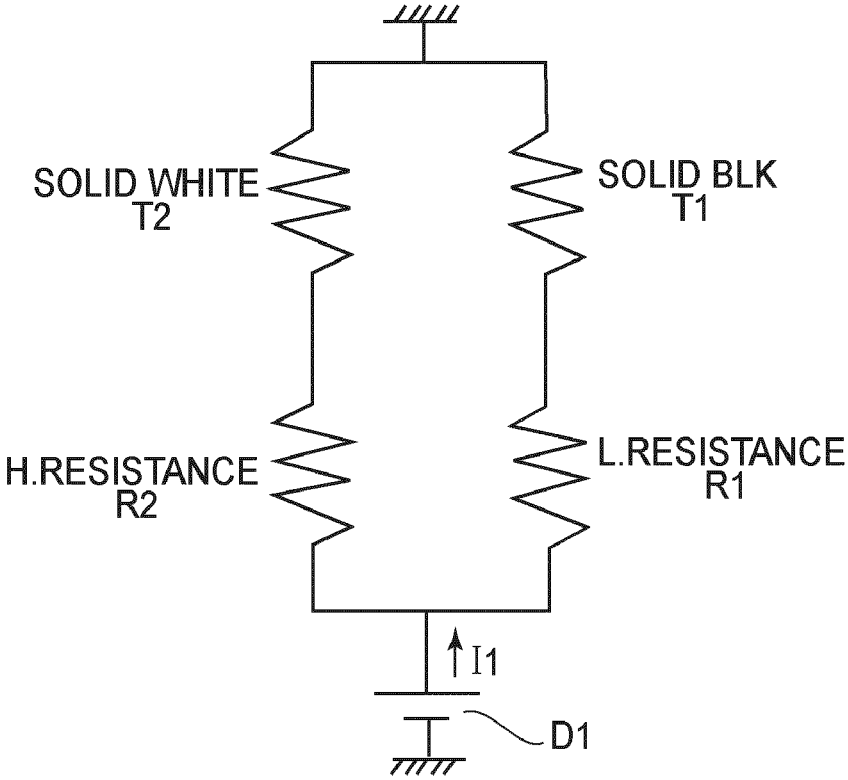
FIG. 10 is a drawing of the equivalent circuit of the primary transfer portion when a toner image of the first test image G1 is conveyed through the transfer portion.
Figure 11:
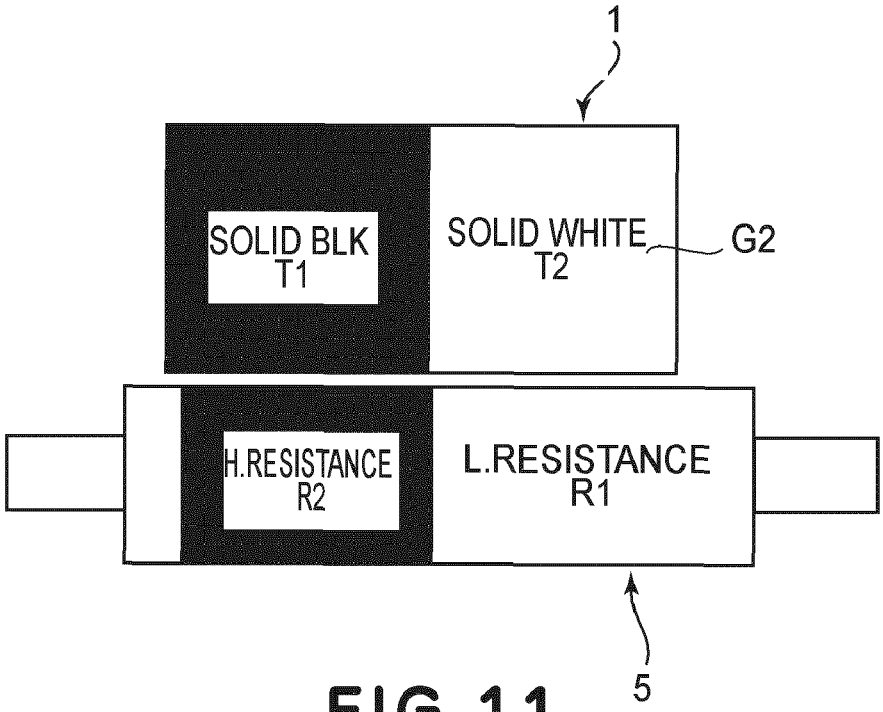
FIG. 11 is a schematic drawing for describing the transfer current amount measuring second step, that is, the step in which a test image G2 is used.
Figure 12:
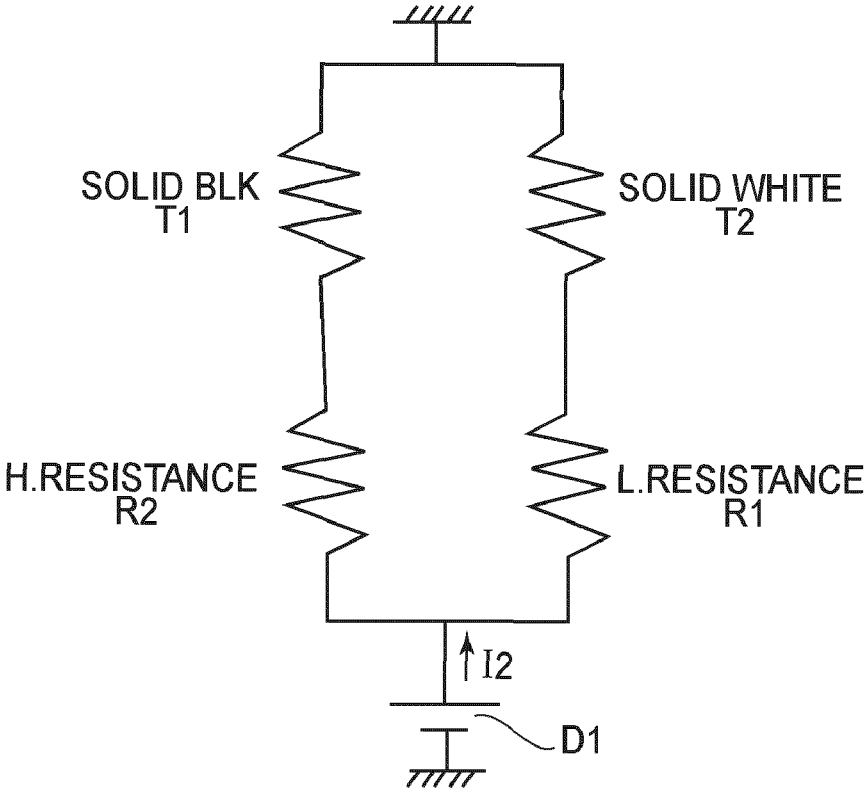
FIG. 12 is a drawing of an equivalent circuit of the primary transfer portion when a toner image of the second test image G2 is conveyed through the transfer portion.

FIG. 7 is a schematic drawing for describing the primary transfer of the test image. FIG. 8 is a flowchart of the control sequence for evaluation of the nonuniformity of the primary transfer roller in electrical resistance. FIG. 9 is a schematic drawing for describing the first measurement (first detection) of the transfer current, which uses the first test image G1. FIG. 10 is a drawing of the equivalent circuit of the transfer portion S1 during the first measurement (first detection). FIG. 11 is a schematic drawing of the second measurement (second detection), in which a test image G2 is used. FIG. 12 is a drawing of the equivalent circuit of the transfer portion S1 during the second measurement (second detection).

Referring to FIG. 7, as well as FIG. 1, if a substantial number of copies of an image, which is nonuniform in density in terms of the direction parallel to the lengthwise direction of the primary transfer roller 5, are continuously made by the image forming apparatus 100, the primary transfer roller 5 gradually becomes nonuniform in electrical resistance in terms of its lengthwise direction. If the nonuniformity continuously grows, some portions of the primary transfer roller 5 are liable to become unsatisfactory in terms of transfer performance.

Thus, the control portion 110 evaluates the primary transfer roller 5 in terms of its lengthwise nonuniformity in electrical resistance for every two hundred copies formed by the image forming apparatus 100. Then, if it determines that the extent of the nonuniformity is outside the preset range, it prompts a user (operator) to replace the unsatisfactory primary transfer roller 5 through the control panel 108.

More specifically, the control portion 110 forms a toner image of the test image G1 (FIG. 9) and a toner image of the test image G2 (FIG. 11). The test image G1 is nonuniform in the amount of toner per unit area (which, hereafter, may be referred to as a toner deposition amount), in terms of the direction parallel to the axial line of the primary transfer roller 5. The test image G2 is different from the test image G1 only in the positioning of the solid white area and solid black area. Then, it measures the amount of the transfer current, which flows through the transfer portion S1 when the toner image of the test image G1 is transferred, and when the toner image of the test image G2 is transferred. The size of the test image G1 is the same as a size of an A4 recording medium. The half of the test image G1 in terms of the direction parallel to the lengthwise direction of the primary transfer roller 5 is solidly white (solid white portion Gw), and the other half is solidly black (solid black portion Gb). The test image G2 is reverse in toner distribution to the test image G1 in terms of the direction parallel to the axial line of the primary transfer roller 5.

The amount of toner deposition, which corresponds to the solid white portion Gw of the test image G1 or G2, is virtually 0 mg/cm$^2$, and that which corresponds to the solid black portion Gb of the test image G1 or G2 is 0.65 mg/cm$^2$. In terms of the direction parallel to the moving direction of the intermediary transfer belt 7, the length of the test image G1 is 60 mm, and so is that of the test image G2, which are greater than the circumference of the primary transfer roller 5.

The test images G1 and G2 are opposite in the positioning of the solid white portion and solid black portion. Therefore, the impedance of the transfer portion S2, while the toner image of the test image G1 passes through the transfer portion S2 is equal to that of the transfer portion S2, while the toner image of the test image G2 passes through the transfer portion S2. Incidentally, it is presumed that two impedances are equal, which means that the difference between the two impedances is no more than ±1%.

After the adjustment of the toner image density level, the control portion 110 makes the image forming apparatus 100 form the toner image of the test image G1 and the toner image of the test image G2, using the electrostatic image formation parameters and electrostatic image development parameters, which were set immediately before the adjustment. Then, the control portion 110 makes the image forming apparatus 100 transfer (primary transfer) the developed electrostatic image (toner image of test image) by applying to the primary transfer roller 5 the constant voltage which was applied immediately before the adjustment. With the employment of the above-described control, the toner deposition amount is restored to the previous level. That is, the electrical resistance of the toner layer is made the same as that when the primary transfer roller 5 was evaluated the last time in its nonuniformity in electrical resistance.

When determining the amount of the transfer current, the amount of transfer current is measured no less than eight times per full rotation of the transfer roller, while rotating the primary transfer roller 5 no less than one full turn. Then, the averages of the no less than eight transfer current values, which correspond to the no less than eight measurements, is adopted as the amount of the transfer current, minimizing the errors attributable to the nonuniformity in electrical resistance of the primary transfer roller 5 in terms of its rotational direction. Further, the deviation in the output voltage of the power source D1 is kept below ±1.5%, keeping thereby the deviation of the transfer current attributable to the deviation of the constant voltage below roughly 1 μA.

If the amount of the transfer current, which flowed when the toner image of the test image G1 was transferred, is the same as that which flowed when the toner image of the test image G2 was transferred, the control portion 110 determines that the primary transfer roller 5 is uniform in the electrical resistance in terms of its lengthwise direction.

Referring to FIG. 7, the toner image of the test image G1 and the toner image of the test image G2 are the same in the amount of the electrical resistance measured in terms of the direction parallel to the lengthwise direction of the primary transfer roller 5, that is, in the sum of the resistance of the portion 5*e* and the resistance of the portion 5*f* in terms of the direction parallel to the lengthwise direction of the transfer portion S1. Therefore, as long as the primary transfer roller 5 is not nonuniform in electrical resistance in terms of its lengthwise direction, the amount of the transfer current, which flows when the toner image of the test image G1 is transferred, is the same as that when the toner image of the test image G2 is transferred.

If the difference in the amount of transfer current, which corresponds to the test image G1 and that which corresponds to the test image G2, is no less than a preset amount, the control portion 110 warns a user (operator) that the primary transfer roller 5 is seriously nonuniform in electrical resistance in terms of its lengthwise direction.

Referring to FIG. 9, as well as FIGS. 1 and 7, the control portion 110 makes the image forming apparatus 100 form a toner image of the test image G1 on the photosensitive drum 1, conveys the formed toner image of the test image G1 to the transfer portion S1, and transfers (primary transfer) the toner image onto the intermediary transfer belt 7 in the transfer portion S1. While transferring the toner image of the test image G1, the control portion 110 makes the current detection circuit A1, which is a current amount detecting portion, measure the amount of the transfer current I1 (S23).

Referring to FIG. 10, in which reference character R1 stands for the electrical resistance of the portion 5*f* of primary transfer roller 5; reference character T1, the impedance of the solid black portion Gb; reference character R2, the electrical resistance of the area 5*e*; and reference character T2 stands for the impedance of the solid white portion Gw, the electrical current, which flows through the portion of the circuit, which is made up of the serially connected resistors R1 and T1, and the electrical current which flows through the portion of the circuit, which is made up of the serially connected resistors R2 and T2, join, creating the transfer current I1.

Further, the control portion 110 makes the image forming apparatus 100 form a toner image of the test image G2 on the photosensitive drum 1, conveys the formed toner image of the test image G2 to the transfer portion S1, transfer (primary transfer) the toner image onto the intermediary transfer belt 7 in the transfer portion S1. While transferring the toner image of the test image G2, the control portion 110 makes the current detection circuit A1, which is a current amount detecting portion, measure the amount of the transfer current I2 (S24).

Referring to FIG. 11, the toner image of the test image G2 is a reverse image to the toner image for the test image G1 in the positioning of the solid black portion and solid white portion. The electrical resistance of the solid black portion is T1, and the electrical resistance of the solid white portion is T2. Referring to FIG. 12, the electrical current which flows through the portion of the circuit, which is made up of the serially connected resistors R1 and resistance T2, and the electrical current which flows through the portion of the circuit, which is made up of the serially connected resistance R2 and resistance T1, join, creating thereby the transfer current I2.

The control portion 110 calculates the values of the resistance R1 and resistance R2, based on the amount of the transfer currents I1 and I2, respectively. Then, it obtains the current density distribution of the primary transfer roller 5 in terms of the lengthwise direction of the primary transfer roller 5 (S25).

Then, the control portion 110 finds the current density range in which the transfer efficiency (which was described before with reference to FIG. 4) is satisfactorily high, by reading the table in the data storing apparatus 109. Then, it determines whether or not the density of the electrical current, which contributed to the transfer (primary transfer) of the solid black portion of the toner image of the test image G by flowing through the black portion, is within the above-mentioned high transfer efficiency range (S26). If the current density is outside the high transfer efficiency range (No in S26), the control portion 110 interrupts (stops) the image forming operation, and displays a message that prompts a user (operator) to replace the primary transfer roller 5 (S27).

The control portion 110 evaluates the secondary transfer roller 11 in lengthwise nonuniformity in electrical resistance by carrying out an operation sequence similar to the operational sequence carried out to evaluate the primary transfer roller 5. The control portion 110 is capable of functioning as a portion for outputting an information regarding an anomaly. Thus, if the current density was outside the high transfer efficiency range, the control portion 110 interrupts (stops) the image forming operation, and displays the message that prompts a user (operator) to replace the secondary transfer roller 11. That is, in the case of an image forming apparatus having a display portion, the message is displayed on the display portion. In the case of a printer, or the like, which does not have a display portion, the control portion 110 outputs a visual signal, an acoustic signal, and/or the like.

The extent of the nonuniformity of the secondary transfer roller 11 in electrical resistance may be evaluated by obtaining the difference or ratio between the value of the resistance R1 and the value of the resistance R2, and comparing the obtained difference or ratio with the referential values stored in advance in the data storing apparatus 109. Further, the extent of the nonuniformity of the secondary transfer roller 11 in electrical resistance may be evaluated by obtaining the difference or ratio between the value of the transfer current I1 and the value of the transfer current I2, and then, comparing the obtained difference or ratio with the referential values. In other words, the nonuniformity of the primary transfer roller 5 (or secondary transfer roller 11) in electrical resistance can be easily evaluated using a method other than the method used in this embodiment, as long as the method other than that in this embodiment measures both the amount of the transfer voltage, which corresponds to the toner image of a test image, and the amount of the transfer voltage, which corresponds to the toner image of another test image, which is the same in electrical resistance value, but is reverse to the first test image in the positional relationship between the solid white portion and solid black portion.

More specifically, in the first measurement, the control portion 110 makes the image bearing member (1, 7) bear a toner image of the first test image G1, which is nonuniform in the toner deposition amount in terms of the direction parallel to the rotational direction of the image bearing member. Then, it measures the amount of the transfer current, which flows through the transfer portion (S1, S2), to which the constant voltage is being applied, while the toner image is moved through the transfer portion, with the use of the current detecting portion (A1, A2).

In the second measurement, the control portion 110 makes the image bearing member (1, 7) bear a toner image of the second test image G2, which is reverse to the first test image G1, in the positional relationship, between the solid white portion and the solid black portion, and measures the amount of current (transfer current), which flows through the transfer portions (S1, S2), to which the constant voltage is being applied, while the toner image of the second test image G2 is moved through the transfer station (S1, S2), with the use of the current detecting portion (A1, A2).

If the difference between the value of the transfer current detected in the first measurement and that in the second measurement is greater than a preset value, the control portion 110 outputs the message that prompts a user to replace the transferring member (5, 10, and 11).

In other words, in order to decide whether or not the nonuniformity of the transferring member in electrical resistance in terms of the lengthwise direction of the transferring member is outside the tolerable range, the control portion 110 relies on the fact that the relationship between the transfer current value obtained in the first measurement and that obtained in the second measurement is affected by the extent of the nonuniformity of the transferring member in electrical resistance in terms of the lengthwise direction of the transferring member. If the nonuniformity is beyond the tolerable range, the control portion 110 outputs a warning. Outputting a warning means at least one among stopping the image formation, transmitting a warning signal to an external device, starting up another apparatus, displaying a message, or the like, etc.

In the first measurement, the amount of current which flows through the serial combination of the transferring member, is possibly nonuniform in electrical resistance in terms of its lengthwise direction and the toner image of the first test image G1, in the transfer portion. Thus, if the transferring member is uniform in electrical resistance, the value of the transfer current directly reflects the resistance value of the toner image of the test image G1 in the transfer portion. In the second measurement, the amount of the current which flows through the combination of the transferring member, which is possibly nonuniform in electrical resistance in terms of its lengthwise direction, and the toner image of the test image G2, is detected. Thus, if the transferring member is free of nonuniformity in electrical resistance, the value of the transfer current directly reflects the resistance value of the toner image of the test image G2.

Therefore, if the transferring member is free of nonuniformity in electrical resistance, the relationship between the transfer current value detected by the first measurement and the transfer current value detected by the second measurement is such that can be computed based on a simple characteristic, that is, the size, of the toner image of the test image G1 and the size of the toner image of the test image G2. Thus, it may be determined that the further the relationship between the transfer current value obtained in the first measurement and the transfer current value obtained in the second measurement from "their relationship which corresponds to when the transferring member is free of nonuniformity in electrical resistance", which is computed based on the size of the toner image of the test image G1 and the size of the toner image of the test image G2, the greater the extent of the nonuniformity of the transferring member in electrical resistance.

<Method for Computing Current Density>

Figure 13:
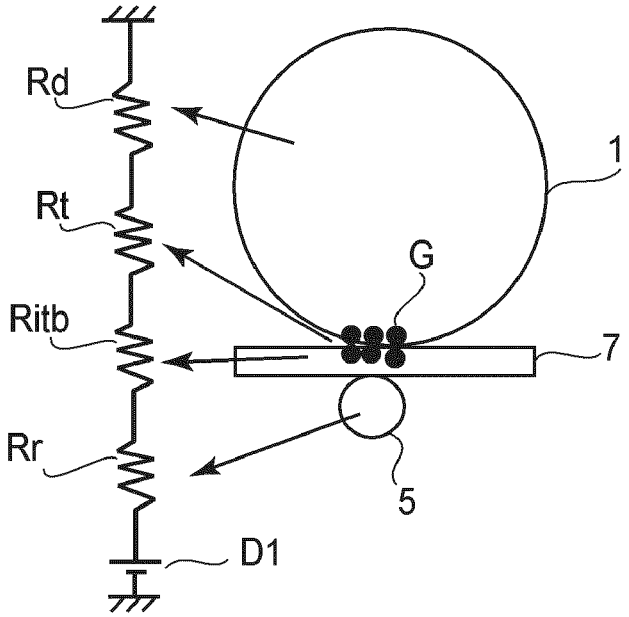
FIG. 13 is a schematic drawing for describing the equivalent circuit of the primary transfer portion.

FIG. 13 is a schematic drawing for describing the equivalent circuit of the primary transfer portion.

Referring to FIG. 13, reference character Rd stands for the electrical resistance of the photosensitive drum 1; reference character Ritb, the electrical resistance of the intermediary transfer belt 7; reference character Rt, the electrical resistance of the toner image; and reference character Rr stands for the electrical resistance of the primary transfer roller 5. Further, reference character T stands for the electrical resistance of the portion of the transfer portion, which excludes the electrical resistance of the primary transfer roller 5 and contributes to the nonuniformity in electrical resistance of the primary transfer portion S1.

The constant voltage V applied from the power source D1 causes the transfer current I to flow through the serial circuit made up of the photosensitive drum 1, toner image, intermediary transfer belt 7, and primary transfer roller 5. The value of the transfer current I can be obtained from the following equations:

$$I=V/R=V/(Rd+Ritb+Rt+Rr)=T+Rr$$

$$T=(Rd+Ritb+Rt).$$

In a case when a substantial number of toner images of the test image G1 are continuously transferred (primary transfer), the portion 5*e* of the primary transfer roller 5 continuously transfers the solid white portion of the toner image of the test image G1, and the portion 5*f* of the primary transfer roller 5 continuously transfers the solid black portion of the toner image. Since electrical current flows through the solid white image portion of the toner image by a greater amount than the amount by which it flows through the solid black portion of the toner image, the electrical resistance R2 of the portion 5*e* becomes greater than the electrical resistance R1 of the portion 5*f*, making the primary transfer roller 5 nonuniform in electrical resistance. In reality, it is possible that a minute amount of electrical current c will leak into the toner-free portion of the image. In this embodiment, however, it is assumed that the effects of this minute amount of electrical current c are negligibly small.

If a toner image of the test image G1 is transferred (primary transfer) by applying the constant voltage V, the value of the overall resistance R1 of the transfer portion when the constant voltage V is applied, the value of the transfer current I1, which flows through the transfer portion when the constant voltage V is applied, can be obtained by the following equations:

$$R1=(R1+T1)(R2+T2)/(R1+T1+R2+T2)$$

$$T1=(Rd1+Ritb1+Rt1)$$

$$T2=(Rd2+Ritb2+Rt2)$$

$$I1=V/R1=V(T1+T2+R1+R2)/\{(T1+R2)(T2+R1)\}.$$

Next, referring to FIG. 12, in the case where a toner image of the test image G2 is transferred (primary transfer) by a constant voltage V, the value of the overall electrical resistance R2 of the transfer portion to which the constant voltage V is applied, and the value of the transfer current I2, which flows through the transfer portion while the constant voltage V is applied thereto, can be obtained from the following equations:

$$R2=(R1+T2)(R2+T1)/(R1+T1+R2+T2)$$

$$I2=V/R2=V(T1+T2+R1+R2)/\{(T1+R2)(T2+R1)\}.$$

The difference ΔI between the amount of transfer current I1 and the amount of the transfer current I2 can be obtained from the following equation:

$$\Delta I=I1-I2=V(T1R2+T2R1-T1R1-T2R2)/(R1+T1+R2+T2) \quad (1)$$

The electrical resistance T1 and electrical resistance T2 in Equation (1) are constant, and are stored in advance in the data storing apparatus 109.

When the primary transfer roller 5 is brand-new, it is virtually uniform in electrical resistance in terms of its lengthwise direction. Therefore, R1≈R2, and, therefore, ΔI=0.

In the above-described case, the primary transfer roller 5 has become nonuniform in electrical resistance in its lengthwise direction (R2>R1). There is the difference ΔI (ΔI<0) between the amount of the transfer current I1, which corresponds to the test image G1, and the amount of the transfer current I2 which corresponds to the test image G2.

The overall electrical resistance R5 of the primary transfer roller 5 can be obtained from the following equation:

$$R5=1/(1/R1+1/R2) \quad (2)$$

Substituting equation (2) for R5 in Equation (1) yields the following equation:

$$\Delta I=V(T1-T2)\{(R5-R2)(T1+T2+R2)+R2R5\}\{R2R5-R2(R5-R2)\}/[(T2+R2)(T1+R2)\{T1(R5-R2)+R2R5\}\{R2R5+T2(R5-R2)\}]. \quad (3)$$

The value of the electrical resistance R5 can be obtained from an equation (R5=V/I5) by detecting the amount of the transfer current I5, which flows when transferring (primary transfer) a solid white image by applying the constant voltage V, the value of which is set through the ATVC sequence carried out immediately before the transfer. The values of the difference ΔI (=I1−I2), T1, and T2 are known. Therefore, the value of the electrical resistance R2 can be computed. Thus, the value of the electrical resistance R1 can be calculated using Equation (2), which shows the relationship among the resistance R1, resistance R2, and resistance R5 (=1/(1/R1+1/R2)).

$$R1=R2\times R5/(R5-R2) \quad (4)$$

With the value of the electrical resistance R1 and the value of the electrical resistance R2 known, the amount of the current which contributes to the toner image transfer by flowing through the solid black portion, the portion of the primary transfer roller 5, the electrical resistance of which is R1, and the portion of the primary transfer roller 5, the electrical resistance of which is R2, while the constant voltage V is applied, can be calculated. Therefore, the current densities Im1 and Im2, which correspond to the solid black portion of the test image G1 and the solid black portion of the test image G2, respectively, can be calculated.

$$Im1=(V/(T1+R1))/14.8 \text{ cm}$$

$$Im2=(V/(T1+R2))/14.8 \text{ cm}.$$

Thus, the point in time at which the primary transfer roller 5 is to be replaced is determined by obtaining the current densities Im1 and Im2, which correspond to the solid black portion of the test image G1 and the solid black portion of the test image G2, respectively, with the use of the above-described method.

The nonuniformity of the secondary transfer roller 11 in electrical resistance in terms of its lengthwise direction is also evaluated by obtaining the current densities, which correspond to the solid black portion of the test image G1 and the solid black portion of the test image G2, using a sequence similar to that used to evaluate the primary transfer roller 5.

Example 1

FIG. 13 is a graph for describing the unsatisfactory transfer which occurred as a large number of toner images of the test image G1 or G2 were continuously made.

Figure 14:
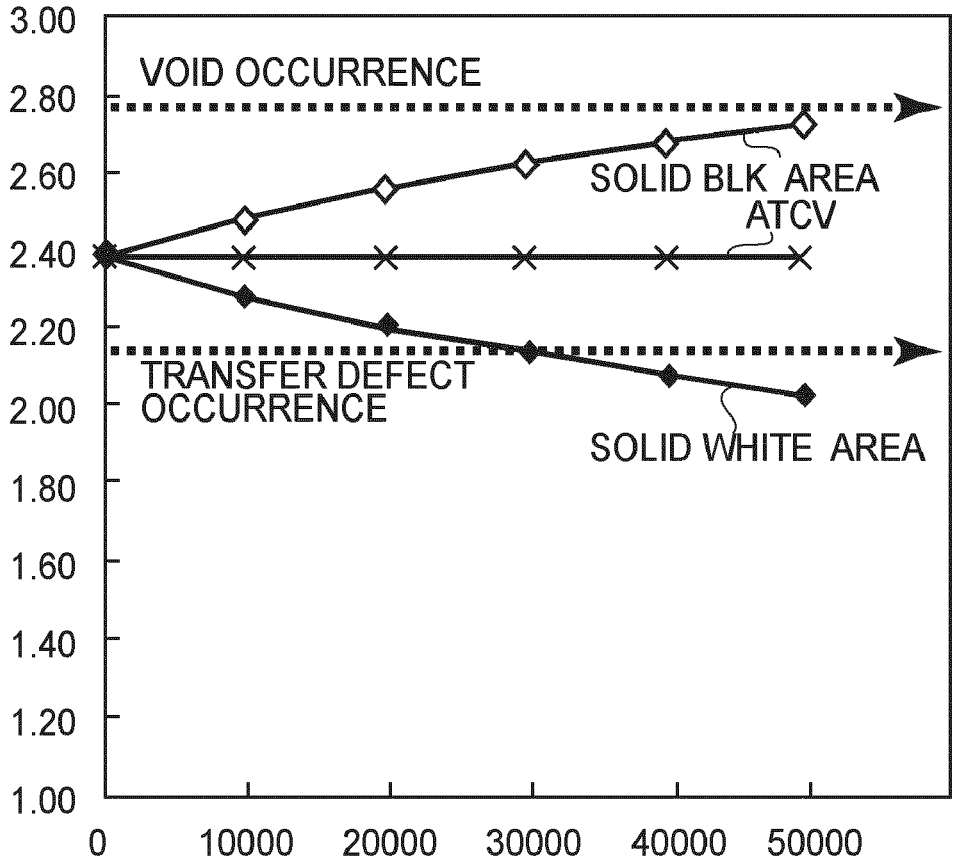
FIG. 14 is a graph for describing the cause of an unsatisfactory transfer, which occurs when a substantial number of copies of a test image are continuously formed.

Referring to FIG. 14, as well as to FIG. 7, a test in which 5,000 copies (toner images) of the test image G1 were continuously made was carried out. During the test, the portion 5*e* of the primary transfer roller 5, which corresponded to the solid white portion Gw of the test image G1 became higher in electrical resistance than the portion 5*f* of the primary transfer roller 5, which corresponded to the solid black portion Gb of the test image G1, by an amount equivalent to the cumulative difference between the amount of the transfer current which flowed through the portion 5*f*, that is, the portion corresponding to the solid black portion Gb, and the amount of the transfer current which flowed through the portion 5*e*, that is, the portion corresponding to the solid white portion Gw. As described above, the primary transfer roller 5 has a property that, as electrical current flows through the primary transfer roller 5 in a specific direction, it increases in electrical resistance by the amount corresponding to the cumulative amount of the electrical current. Further, the electrical current, which flows through the transfer portion S1, flows more through the portion of the transfer portion S1, which corresponds to the solid white portion Gw, which is lower in electrical resistance than the solid black portion Gb, than through the portion of the transfer portion S1, which corresponds to the solid black portion Gb.

Therefore, even if it is ensured by the ATVC sequence that the total amount by which the transfer current flows through the primary transfer roller 5 is constant at 50 μA, the difference in electrical resistance between the portion 5*e*, by which the solid white portions Gw are continuously transferred, and the portion 5*f*, by which the solid black portions Gb are continuously transferred, gradually increases, eventually making the primary transfer roller 5 significantly nonuniform in electrical resistance in terms of its lengthwise direction. Therefore, the density (A/cm) of the electrical current c, which flows at the time of the primary transfer of the portion of the toner image of the test image G1, which corresponds to the solid black portion of the test image G1, is different from the density (A/cm) of the electrical current c, which flows at the time of the primary transfer of the portion of the toner image of the test image G2, which corresponds to the solid black portion of the test image G2.

During the pre-rotation step, which was carried out immediately before the starting of an image forming operation for continuously making a large number of copies, the primary transfer roller 5 was evaluated regarding its lengthwise nonuniformity in electrical resistance. Then, during the image forming operation, the primary transfer roller 5 was evaluated regarding its lengthwise nonuniformity in electrical resistance, for every two hundredth copy. Each time the primary transfer roller 5 was evaluated regarding the lengthwise nonuniformity in electrical resistance, the ATVC sequence was carried out to reset the constant voltage to a specific value, which made the overall amount by which the transfer current flowed through the primary transfer roller 5 be 50 μA.

Referring to FIG. 14, in the first embodiment, the unsatisfactory transfer, which is referred to as a "weak current white spot" occurred when the current density Ib was no more than 2.14 μA/cm, and the unsatisfactory transfer, which is referred to as a "strong current white spot" occurred when the current density Ib was no less than 2.76 μA.

Therefore, as long as the current density Ib was in the range between 2.14 μA/cm and 2.76 μA/cm (2.14 μA/cm<Ib<2.76 μA/cm), the control portion 110 (FIG. 1) allowed the image forming apparatus 100 to carry out (continue) the image forming operation. However, when the current density Ib was outside the above-mentioned range, the control portion 110 interrupted the image forming operation, and displayed a message that prompts a user to replace the primary transfer roller 5.

After the completion of the first ATVC sequence, a solid white image was formed while applying +1,500 of constant voltage. The amount of the transfer current, which was detected during this image forming operation, was 75 μA. Thus, when there was no toner image in the transfer portion S1, the calculated impedance of the transfer portion S1 was $2\times10^7\Omega$.

This impedance was the sum of the impedance of the photosensitive drum 1, the impedance of the intermediary transfer belt 7, and the impedance of the primary transfer roller 5, which made up the transfer portion S1. Further, the initial electrical resistance of the primary transfer roller 5 itself was $1\times10^7\Omega$. Therefore, the sum (2×T2) of the impedance of the photosensitive drum 1 and the impedance of the intermediary transfer belt 7 was $1\times10^7\Omega$. On the other hand, when the amount of the transfer current was detected while a solid black image were transferred, the sum (2×T1) of the impedance of the photosensitive drum 1, the impedance of the intermediary transfer belt 7, and the impedance of the toner image, was $2\times10^7\Omega$.

This operation sequence was intended to obtain the impedances T1 and T2, which corresponded to the image portion (portion of image, which is made up of toner) and a non-image portion (portion of image, which is free of toner). Thus, the value of the impedance T1 and the value of the impedance T2 were obtained by carrying out the operational sequence during the pre-rotation period, which was immediately before the first image was formed by the image forming apparatus 100.

Thereafter, before starting an image forming operation in which a large number of copies were continuously made, the amount of the transfer current I1 and the amount of the transfer current I2 were measured, while forming a toner image of the test image G1 (FIG. 10) and a toner image of the test image G2 (FIG. 12). The amount of the transfer current I1 and the amount of the transfer current I2 were both roughly 62.5 μA. In other words, the current amount difference ΔI calculated using Equation (1) was zero, confirming that the primary transfer roller 5 was virtually free of nonuniformity in electrical resistance in terms of its lengthwise direction.

Thereafter, an operation for continuously forming two hundred copies of the test image G1 was started, and two hundred toner images of the test image G1 were continuously transferred (primary transfer) onto the intermediary transfer belt 7 in the transfer portion S1 to which the constant voltage of +1,500 V was being applied.

After two hundred copies of the test image G1 were outputted, the ATVC sequence was carried out. As a result, the constant voltage was set to +1,530 V, which was higher by 30 V than the preceding constant voltage value.

After the completion of the adjustment regarding the toner image density, a toner image of the test image G1 and a toner image of the test image G2 were formed while applying the constant voltage of +1,530 V and measuring the amount of the transfer current I1 and the amount of the transfer current I2, in order to evaluate the lengthwise nonuniformity, in electrical resistance, of the primary transfer roller 5.

The difference ΔI between the amount of the transfer current I1 and the amount of the transfer current I2 was roughly 0.2 μA. Then, the value of the electrical resistance R1 of the primary transfer roller 5 and the value of the electrical resistance R2 of the primary transfer roller 5 were obtained based on the obtained value of the difference ΔI. Then, the value of the current density Ib1 and the value of the current density Ib2 were calculated.

The calculated value of the current density Ib1, which corresponded to the solid black portion of the test image G1, was 2.39 μA/cm, and the calculated value of the current density Ib2, which corresponds to the solid black portion of the test image G2 was 2.37 μA/cm. In other words, the current densities Ib1 and Ib2 are both higher than 2.14 μA/cm and lower than 2.76 μA/cm (2.14 μA/cm<Ib<2.76 μA/cm). Thus, the operation for forming a two hundred first toner image of the test image G1 and the rest of the interrupted image forming operation was restarted.

The image forming operation in which a large number of copies of the test image G1 were continuously made and in which the primary transfer roller 5 was evaluated for every two hundredth copy, was carried out, was interrupted after roughly 30,000 copies were made, and a message that prompts a user to replace the primary transfer roller 5 was displayed. Then, the constant voltage was set to +1,985 V through the ATVC sequence. Then, the amount of the transfer current I1 and the amount of the transfer current I2 were measured while applying a constant voltage of +1,985 V. The difference ΔI between the transfer current I1 and transfer current I2 had increased to 4.0 μA. As described above, the deviation of the amount of the transfer current, which is attributable to the deviation of the constant voltage, was roughly 1 μA. Therefore, the current amount difference ΔI of 4.0 μA was a reliable value.

From the results of the test, which was carried out to measure the amount of transfer current while applying the constant voltage of 1,985 V after the ATVC sequence, the electrical resistance R5 of the primary transfer roller 5 measure after roughly 30,000 copies were made was $3.97\times10^7\Omega$. The value of the impedance T1, which corresponded to the solid black portion of the test image G1 and was obtained first, was $4\times10^7\Omega$, and the value of the impedance T2, which corresponds to the solid white portion of the test image G1, were $2\times10^7\Omega$. Substituting these values for the parameters in Equations (3) and (4), the calculated value of the electrical resistance R1 and that of the resistance R2 were $3.2\times10^7\Omega$ and $4.85\times10^7\Omega$, respectively.

Thus, the current density Ib1, which corresponded to the solid black portion of the test image G1 was 2.60 μA/cm, which was greater than 2.14 μA/cm and less than 2.76 μA/cm (2.14 μA/cm<Ib<2.76 μA/cm). However, the current density Ib2, which corresponds to the solid black portion of the test image G2, was 2.14 μA/cm, which was smaller than the smallest value in the proper range (2.14 μA/cm<Ib<2.76 μA/cm).

Next, a toner image of the test image G2 was formed by forcefully restarting the interrupted image forming operation. The obtained copy confirmed that the so-called "weak current white spot" (unsatisfactory transfer attributable to unsatisfactory amount of transfer current) had occurred to the portion of the toner image, which corresponded to the solid black portion of the test image G2, confirming that the judgment made by the control portion 110 was correct.

Incidentally, in this embodiment, in consideration of measurement errors, if the difference ΔI is no less than 3.5 μA, it is determined that the extent of the lengthwise nonuniformity, in electrical resistance, of the primary transfer roller 5 in its lengthwise direction has reached the level which will result in the formation of an unsatisfactory image.

Referring to FIG. 14, as well as to FIG. 7, regardless of the increase in the cumulative number by which toner images of the test image G1 were made, it is ensured by the ATVC that the average value of the overall electrical resistance of the primary transfer roller 5 remains constant at 2.4 μA/cm. However, the portion 5*e* of the primary transfer roller 5, which transfers (primary transfer) the portion of the toner image, which corresponds to the solid white portion Gw, is greater than the portion 5*f* of the primary transfer roller 5, which transfers the portion of the toner image, which corresponds to the solid black portion Gb of the test image G1, in the speed at which their electrical resistance increases.

Therefore, the current density, which corresponds to the portion 5*e*, which transfers (primary transfer) the solid black portion when a toner image of the test image G2 is transferred (primary transfer), is made smaller than the current density, which corresponds to the portion 5*f*, which transfers the solid black portion Gb when a toner image of the test image G1 is transferred. Further, the amount of difference between the current density, which corresponds to the solid black portion the when the test image G1 is transferred (primary transfer) and the current density, which corresponds to the solid black portion when the test image G2 is transferred (primary transfer), gradually increases with the increase in the cumulative number of the copies, which are continuously made.

Thus, as a large number of toner images of the test image G1 are continuously transferred (primary transfer) by the primary transfer roller 5, it becomes impossible for a sufficient amount of transfer current to flow through the portion 5*e* of the primary transfer roller 5, which corresponds to the solid white portion Gw of the test image G1, and, therefore, the amount by which the toner fails to be transferred from the photosensitive drum 1 increases. That is, the so-called "weak current white spot" is liable to occur.

On the other hand, as a large number of toner images of the test image G2 are continuously transferred (primary transfer), an excessive amount of transfer current flows through the portion 5*f*, and, therefore, the toner particles, which come into contact with the portion 5*f* are reversed in polarity, being thereby transferred back onto the photosensitive drum 1. That is, the so-called "strong current white spot" is liable to occur.

Incidentally, in the past, the point in time at which the primary transfer roller 5 is to be replaced was determined based on the overall electrical resistance of the primary transfer roller 5. Further, the upper limit for the electrical resistance R5 was set according to the maximum output value of the power source D1. In the case of the image forming apparatus 100 in this embodiment, when the value of the constant voltage exceeded 5 kV, a defective image, more specifically, an image suffering from the white spots attributable to excessively high voltage was formed. Therefore, it did not occur that the upper limit of the constant voltage is set to a value greater than 5 kV.

However, replacing the primary transfer roller 5 as the value of the constant voltage exceeds 5 kV does not solve the problem that a large number of the same or similar copies are continuously made, the primary transfer roller 5 gradually becomes nonuniform in electrical resistance, which results in unsatisfactory transfer.

Further, the method, which relies on the overall current density of the transfer portion S1 to control the point in time at which the primary transfer roller 5 is to be replaced, also cannot solve the problem that as a substantial number of the same or similar copies are continuously made, the primary transfer roller 5 gradually becomes nonuniform in electrical resistance, which results in unsatisfactory transfer.

Referring to FIG. 14, even if the overall current density of the transfer portion S1 is kept constant by the ATVC, regardless of the changes in the electrical resistance value of the primary transfer roller 5, it is still possible that a part or parts of the primary transfer roller 5 fail to satisfactorily transfer the toner particles. That is, even if the ATVC sequence is executed using a solid black toner image, so that the center value of the current density I will become 2.38 μA/cm, a part or parts of the primary transfer roller 5 may fail to satisfactorily transfer the toner particles because of the lengthwise nonuniformity of the primary transfer roller 5 in electrical resistance.

Therefore, regardless of which of the methods described above was employed, it was necessary that as soon as a part or parts of the primary transfer roller 5 actually failed to satisfactorily transfer the toner particles, whether or not the primary transfer roller 5 was to be replaced was determined by an expert to replace the primary transfer roller 5 before the value of the constant voltage reached 5 kV.

In comparison, in the first embodiment, the primary transfer roller 5, which is an example of a transferring member, forms the transfer portion S1, which is an example of a transfer portion, by being pressed against the photosensitive drum 1, which is an example of an image bearing member, with the intermediary transfer belt 7, which is an example of a transfer medium, placed between the primary transfer roller 5 and photosensitive drum 1.

The power source D1, which is an example of an electrical power supplying means, transfers a toner image from the photosensitive drum 1, which is an example of an image bearing member, onto the intermediary transfer belt 7, which is an example of a transfer medium, by applying transfer voltage to the transfer portion S1, which is an example of a transfer portion.

The current detection circuit A1, which is an example of a current amount detecting means, detects the amount of the electrical current c, which flows through the transfer portion S1, which is an example of a transfer portion, while the transfer voltage is applied thereto.

In Step S23, which is an example of a first transfer current amount measuring step, the amount of transfer current is measured using a toner image of the test image G1, which is an example of an image which is made up of a solid white portion Gw and a solid black portion Gb, that is, an image which is extremely nonuniform in density.

In Step S24, which is an example of a second transfer current amount measuring step, the amount of transfer current is measured using a toner image of the test image G2, which is an example of an image, which is different from the test image G1 only in the density distribution.

The control portion 110 determines whether or not the extent of the lengthwise nonuniformity in electrical resistance of the primary transfer roller 5 has exceeded the tolerable range, based on the results from Step S23, which is an example of the first transfer current measurement, and the results from Step S24, which is an example of the second transfer current measurement. Then, if it determines that the measured extent of the lengthwise nonuniformity of the primary transfer roller 5 in electrical resistance has exceeded the tolerable range, it outputs a warning signal. Outputting a warning signal means at least one among transmitting a warning signal to an external device, displaying some warning message (sign), or the like, etc.

In other words, the control portion 110 generates a message that concerns (at least resultantly) the possibility that the unsatisfactory transfer attributable to the lengthwise nonuniformity, in electrical resistance, of the primary transfer roller 5, which is an example of a transferring member, may occur, based on the results from Steps S23 and S24, in which the amount of transfer current was measured.

Further, the control portion 110 is capable of issuing a warning signal, a warning message, a simple electrical signal, or an evaluation report, which are examples of an output which shows the result of the evaluation, by accessing the referential values or data base in the data storing apparatus 109, and carrying out various computational processes. Further, the control portion 110 outputs a message that recommends, requests, or demands a user to replace the transfer roller, and/or outputs an evaluation report, so that the primary transfer roller 5 will be resultantly replaced.

Therefore, while the value of the constant voltage is as low as +1,985 V, which is significantly lower than +5,000 V, the control portion 110 is capable of predicting the occurrence of the problem that a part or parts of the primary transfer roller 5 fail to satisfactorily transfer the toner particles, and outputting a message that requests a user to replace the primary transfer roller 5. Therefore, it is possible to prevent all types of the unsatisfactory toner particle transfers which will possibly occur before the value for the constant voltage will have to be set to +5,000 V while roughly 30,000 copies will be outputted.

Embodiment 2

Figure 15:
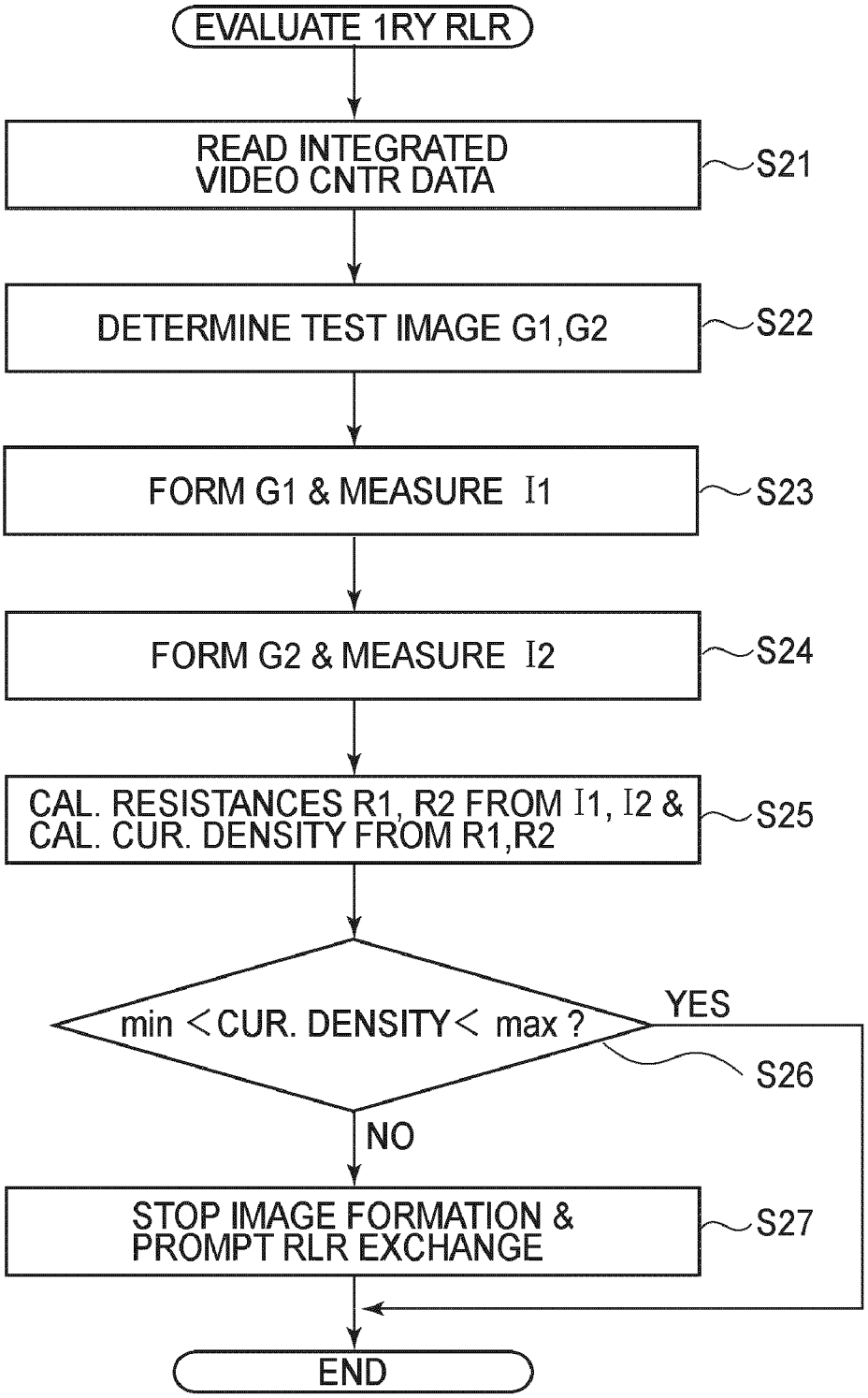
FIG. 15 is a flowchart of the operational sequence for evaluating the primary transfer roller in the second embodiment, in terms of its nonuniformity in electrical resistance.
Figure 16:
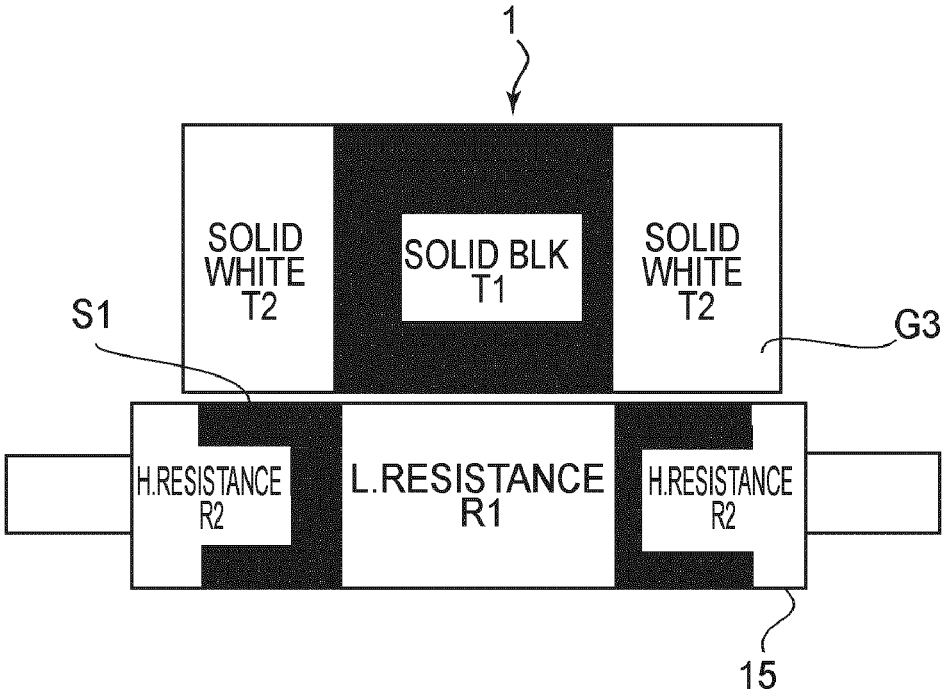
FIG. 16 is a schematic drawing for describing the transfer current amount measuring first step when a test image G3 is used.
Figure 17:
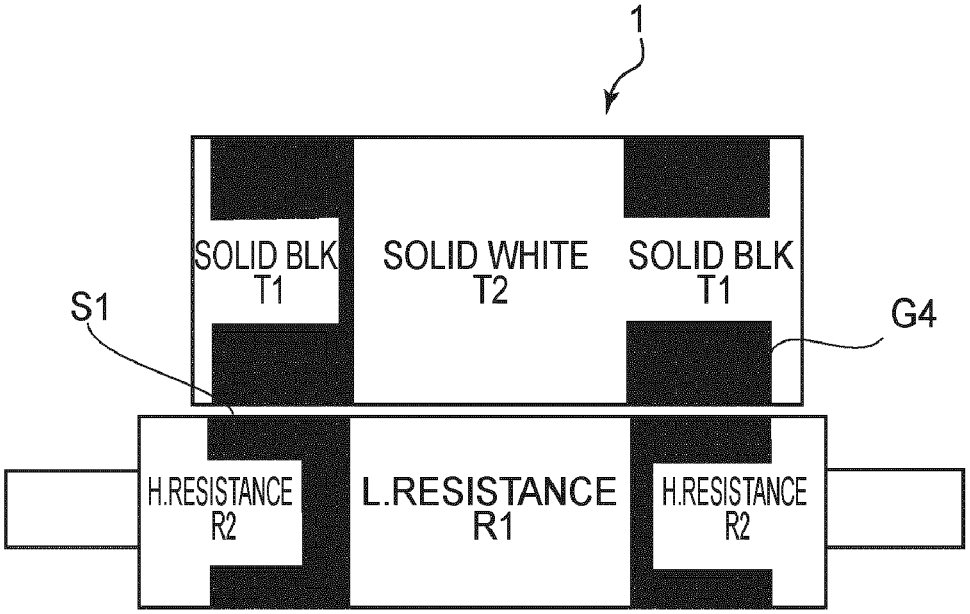
FIG. 17 is a schematic drawing for describing the transfer current amount measuring second step when a test image G3 is used.

FIG. 15 is a flowchart of the control sequence for evaluating the nonuniformity, in electrical resistance, of the primary transfer roller in the second embodiment of the present invention. FIG. 16 is a schematic drawing for describing the transfer current amount measuring first step, which uses a test image G3. FIG. 17 is a schematic drawing for describing the transfer current amount measuring second step, in which a test image G4 is used.

Except for a part of the control sequence for evaluating the lengthwise nonuniformity, in electrical resistance, of the primary transfer roller 5, the second embodiment is the same as the first embodiment. Therefore, the structural components and portions thereof, the portions of a test image, the control sequence steps, etc., in FIGS. 15-17, which are the same as the counterparts in FIGS. 1-4, are given the same referential symbols as those given to the counterparts in the FIGS. 1-4, one for one, and will not be described, to avoid repeating the same descriptions.

Referring back to FIG. 1, the control portion 110 detects an image, the copy of which will be continuously made by a large number, based on the output of a video counter 104. Then, it creates, by computation, a test image G3, which accurately reflects the above-mentioned image, and a test image G4, which is reverse in the positioning of the solid black portion and solid white portion. Then, the control portion 110 carries out a primary transfer roller evaluation sequence, which is similar to that in the first embodiment, using the test images G3 and G4.

The video counter 104 obtains the image density distribution (in terms of the direction parallel to the direction of the primary scanning line) of an image to be formed (copied), by processing the image data of the received job. More specifically, it obtains the image density distribution of each portion of the image, which corresponds to each of the primary scanning lines. Then, it adds up all the image density distributions obtained through the above-described processes. Thus, the final image density distribution is the sum of all the image density distributions, which correspond to all the scanning lines, one for one. The image density was calculated per one centimeter in terms of the direction parallel to the primary scanning lines.

The video counter 104 obtains the image density distribution in the direction parallel to the primary scan lines, for every image which the image forming apparatus forms. Then, it adds up all the image density distributions it obtained since the last evaluation, and outputs to the control portion 110, the data for identifying the toner image deviation on the photosensitive drum 1.

Referring to FIG. 15, as well as to FIG. 1, the control portion 110 obtains the cumulative data from the video counter 104 (S21).

Referring to FIG. 16, the control portion 110 creates the test image G3, which is made up of a single solid black portion and two solid white portions. The positioning of the solid black portion corresponds to the high value ranges of the density distribution derived from the cumulative data.

Referring to FIG. 17, the control portion 110 creates the test image G4, which is made up of two solid black portions and a single solid white portion. It is a reverse image of the test image G3 in terms of the positioning of the solid white portion and solid black portion (S22).

As with the relationship between the test images G1 and G2 in the first embodiment, the test images G3 and G4 are created so that they are the same in the sum of the overall length of the solid black portion and overall length of the solid white portion in terms of the direction parallel to the lengthwise direction of the primary transfer roller 5. Therefore, the test images G3 and G4 are equal in electrical resistance value.

The control portion 110 creates a pair of test images. One of the test images is made up of a single solid black portion, and two identical solid white portions, which are half in length in terms of the direction parallel to the lengthwise direction of the primary transfer roller (transfer portion). The other test image is made up of two identical solid black portions, and a single solid white portion, which is twice the solid black portion in length. Thus, the sum of the solid black portions, which correspond to the high density portions of the image, the cumulative data of which was detected by the video counter 104, is equal to the sum of the solid black portions, which corresponds to the low density portions of the image, the cumulative data of which was detected by the video counter 104. Thus, in a case where multiple copies of the test image G3 were continuously made, the control portion 110 evaluates the lengthwise nonuniformity, in electrical resistance, of the primary transfer roller 5 by forming a toner image of the test image G3 and a toner image of the test image G4. Needless to say, in a case where multiple copies of the test image G1 were continuously made, a toner image of the test image G1 and a toner image of the test image G2 are automatically made through the same process.

The control portion 110 forms a toner image of the test image G1 on the photosensitive drum 1, conveys the image to the transfer portion S1, and transfers (primary transfer) the image onto the intermediary transfer belt 7 in the transfer portion S1. Further, it measures the amount of transfer current I1 by the current detection circuit, while transferring the image (S23).

Next, the control portion 110 forms a toner image of the test image G2 on the photosensitive drum 1, conveys the image to the transfer portion S1, and transfers (primary transfer) the image onto the intermediary transfer belt 7 in the transfer portion S1. Further, it measures the amount of the transfer current I2 by the current detection circuit A1, while transferring the image (S24).

Then, the control portion 110 calculates the value of the electrical resistance R1 (resistance of low resistance portion of transfer roller) and the value of the electrical resistance R2 (resistance of high resistance portion of transfer roller), based on the value of the transfer current I1 and the value of the transfer current I2. Then, it obtains the current density distribution in terms of the direction parallel to the lengthwise direction of the primary transfer roller 5 (S25).

Then, the control portion 110 accesses the data storing apparatus 109 and reads the ranges in which the transfer efficiency is high, as it was described with reference to FIG. 4, and determines whether or not the value of the density of the current which flowed through the portions of the primary transfer roller 5, which corresponded to the solid black portions to transfer (primary transfer) the toner particles, is in the high transfer efficiency range (S26). If the current density is outside the high transfer efficiency range (No in S26), the control portion 110 interrupts the image forming operation or prohibits the continuation of the image forming operation, and displays a message that prompts a user to replace the primary transfer roller 5 (S27).

The control portion 110 also evaluates the secondary transfer roller 11 using an evaluation sequence similar to that used for evaluating the primary transfer roller 5. If the obtained current density is outside the high transfer efficiency range, it interrupts the image forming operation or prohibits the continuation of the image forming apparatus, and displays a message that prompts a user to replace the secondary transfer roller 11.

Incidentally, the nonuniformity, in electrical resistance, of the transfer rollers 5 and 11 may be evaluated by obtaining the ratio between the value of the transfer current I1 and transfer current I2, and comparing the obtained ratio with the referential values (data) stored in advance in the data storage apparatus 109. Either way, as long as two toner images, which are the same in overall resistance value, but are reverse in terms of the positioning of their solid black portions and solid white portions, are used, and both the amount of transfer current which flows when one of the toner images is transferred, and the amount of transfer current which flows when the other toner image is transferred, are measured, a method other than the one used in this embodiment, which makes it possible to easily evaluate the nonuniformity, electrical resistance, of the primary transfer roller 5 (or secondary transfer roller 11), may be used.

Example 2

Figure 18A:
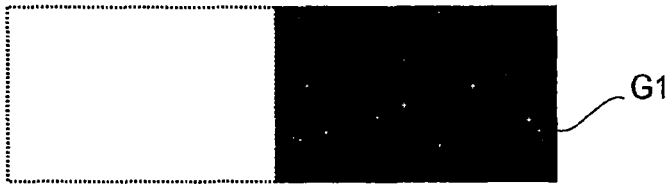
FIGS. 18(*a*) and 18(*b*) are schematic drawings for describing the transfer current amount measuring first step when a test image G1 is used, in which FIG. 18(*a*) represents a test image and FIG. 18(*b*) represents an equivalent circuit of the transfer portion.
Figure 18B:
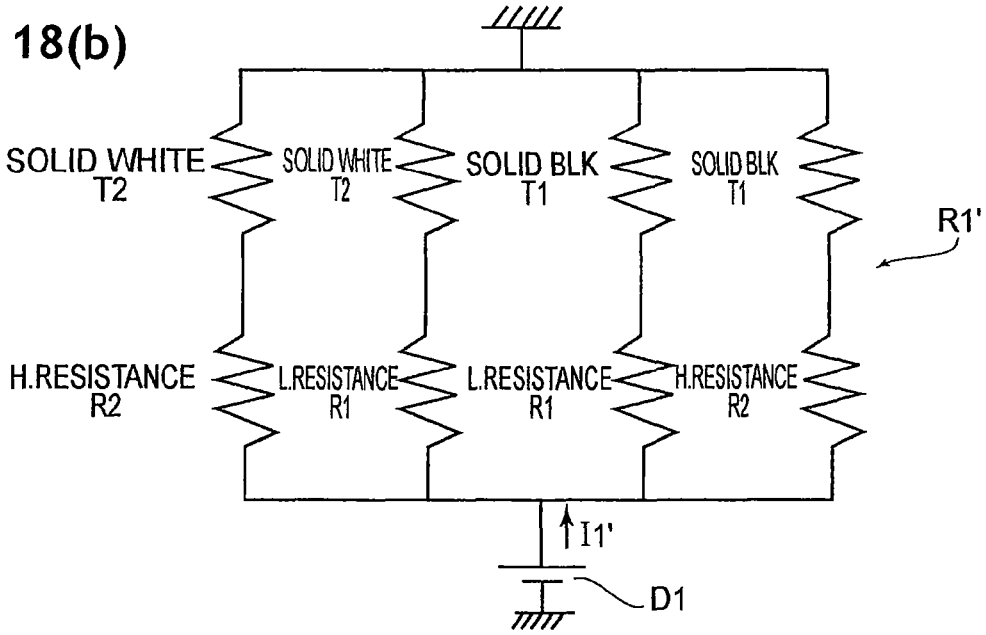
Figure 19A:
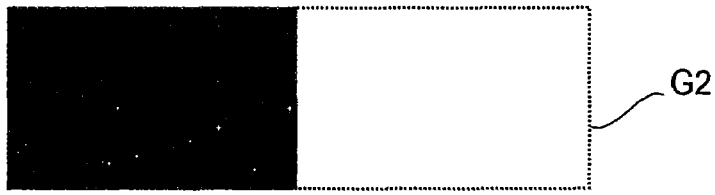
FIGS. 19(*a*) and 19(*b*) are schematic drawings for describing the transfer current amount measuring second step when a test image G2 is used, in which FIG. 19(*a*) represents a test image and FIG. 19(*b*) represents an equivalent circuit of the transfer portion.
Figure 19B:
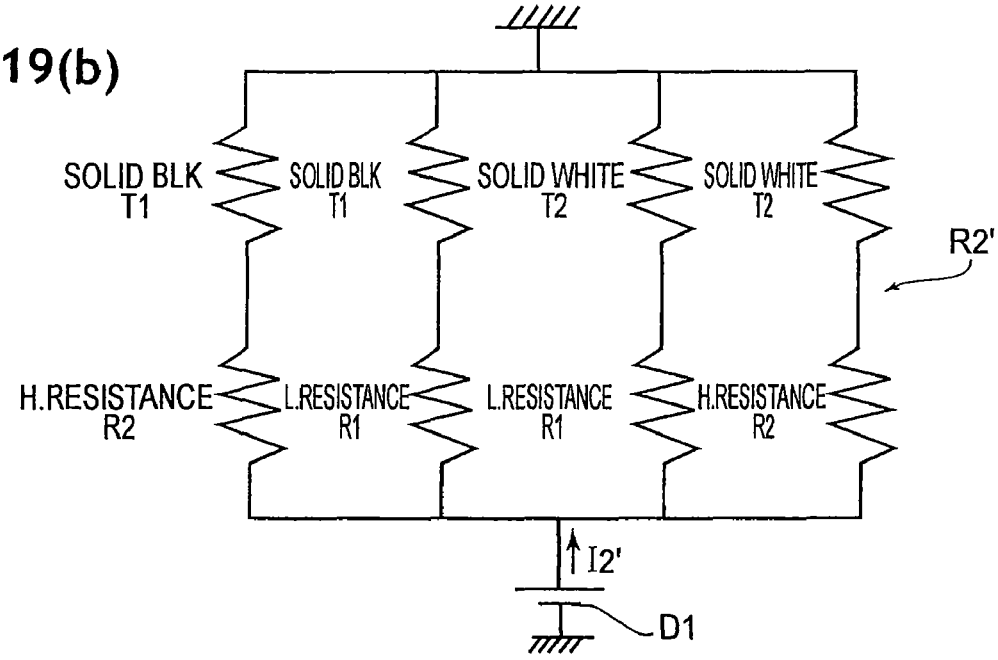
Figure 20A:
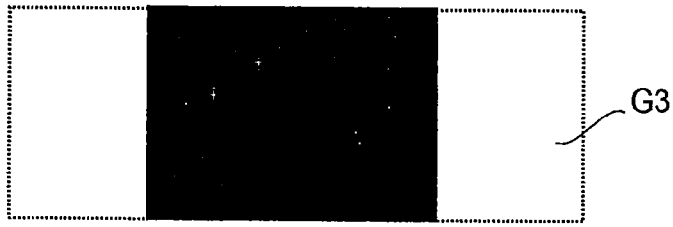
FIGS. 20(*a*) and 20(*b*) are schematic drawings for describing the transfer current amount measuring first step when a test image G3 is used, in which FIG. 20(*a*) represents a test image and FIG. 20(*b*) represents an equivalent circuit of the transfer portion.
Figure 20B:
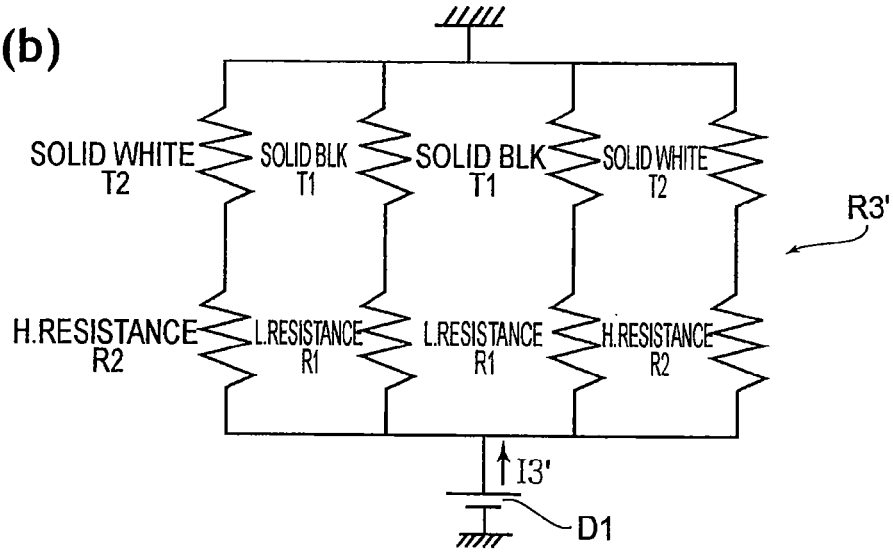

FIGS. 18(*a*) and 18(*b*) are schematic drawings for describing the first measurement of the transfer current, in which the test image G1 is used. FIGS. 19(*a*) and 19(*b*) are schematic drawings for describing the second measurement of the transfer current, in which the test image G2 is used. FIGS. 20(*a*) and 20(*b*) are schematic drawings for describing the first measurement of the transfer current, in which the test image G3 is used. FIGS. 21(*a*) and 21(*b*) are schematic drawings for describing the second measurement of the transfer current, in which the test image G4 is used. Of FIGS. 18(*a*)-21(*b*), the drawing referenced by (a) is a test image, and the drawing referenced by (b) is an equivalent circuit of the transfer portion.

Referring to FIG. 16, the test image G3 is made up of a single solid black portion and two solid white portions equal in length (size). The solid black portion occupies the center portion of the image. Its size is equivalent to 50% of the size of the test image G3. The two solid white portions sandwich the solid black portion. Their size is equivalent to 25% of the size of the test image G3. 50,000 copies of the test image G3 were continuously made in an ambience which was 23° C. in temperature, and 50% RH in humidity. Then, the lengthwise nonuniformity, in electrical resistance, of the primary transfer roller 5 was evaluated using a method similar to that used in the first embodiment, in which a toner image of the test image G1 and a toner image of the test image G2 were used, and the ATVC sequence was carried out for every two hundred copies.

In the case of the first embodiment, the control portion 110 interrupted the image forming operation, and displayed a message that prompted a user to replace the primary transfer roller 5, when the cumulative count of the copies made reached roughly 30,000. In the case of this embodiment, however, the message that prompts a user to replace the primary transfer roller 5 was not displayed even after the cumulative count of the copies made exceeded 31,000. Further, the examination of the copies of the test images G1 and G2 formed for the evaluation of the nonuniformity, in electrical resistance, of the primary transfer roller 5, which was carried out immediately after the completion of the 30,000th copy, revealed that the unsatisfactory transfer had already begun. That is, the portion of the primary transfer roller 5, which continuously transferred the solid white portions, had increased in electrical resistance. Therefore, the unsatisfactory transfer (under current white spots) had occurred to the portion of the toner image, which corresponded in position to the solid black portion of the test image G1 and the portion of the toner image, which corresponded in position to the solid black portion of the test image G2.

The value to which the constant voltage was set through the ATVC sequence, which was carried out immediately after the completion of the 30,000th copy, was +1,985 V, as it was set in the first embodiment. However, the difference ΔI between the amount of the transfer current I1, which was measured when the test image G1 was used, and the amount of the transfer current I2, which was measured when the test image G2 was used, was virtually 0 μA. Therefore, the control portion 110 determined that the electrical resistance R1 and electrical resistance R2 of the primary transfer roller 5 were equal in value.

The center portion of the test image G3 is solid black, which is high in impedance T1, whereas the two lateral portions of the test image G3 are solid white, being relatively low in impedance T2. Therefore, the portions of transfer portion S1, which correspond to the solid white portions of the test image G3, one for one, are higher in current density than the portion of the transfer portion S1, which corresponds to the solid black portion of the test image G3. Thus, the electrical resistance R2, which corresponds to the lateral portions of the primary transfer roller 5, that is, the portions which continuously transferred the solid white portions of the toner image, are higher in value than the electrical resistance R1, which corresponds to the center portion of the toner image.

Referring to FIG. 18(*b*), there is the following relationship between the overall impedance R1' of the test image G1 and the total amount of electrical current I1', which flows through the test image G1 when the constant voltage V is applied:

$$R1' = 1/\{1/(R2+T1)+1/(R1+T1)+1/(R1+T2)+1/(R2+T2)$$

$$\begin{aligned} I1' &= V/R1' \\ &= V\{1/(R2+T1)+1/(R1+T1)+1/(R1+T2)+ \\ &\quad 1/(R2+T2). \end{aligned}$$

Referring to FIG. 19(*b*), there is the following relationship between the overall impedance R2' of the test image G2 and the total amount of electrical current I2', which flows through the test image G2 when the constant voltage V is applied:

$$R2' = 1/\{1/(R2+T1)+1/(R1+T1)+1/(R1+T2)+1/(R2+T2)$$

$$\begin{aligned} I2' &= V/R2' \\ &= V\{1/(R2+T1)+1/(R1+T1)+1/(R1+T2)+ \\ &\quad 1/(R2+T2). \end{aligned}$$

Therefore, the amount of the difference ΔI (=I2'−I1') is 0:

$$\Delta I = I2' - I1' = 0.$$

Therefore, at least in the case where multiple copies of the test image G3 are continuously made, the control sequence in the first embodiment, which uses the test images G1 and G2, cannot accurately detect the lengthwise nonuniformity, in electrical resistance, of the primary transfer roller 5.

Referring to FIG. 20(*b*), there is the following relationship between the overall impedance R3' of the test image G3 and the total amount of electrical current I3', which flows through the test image G3 when the constant voltage V is applied:

$$R3' = 1/\{1/(R2+T2)+1/(R1+T1)+ = 1/(R1+T1)+1/(R2+T2)\} = 1/\{2/(R1+T1)+2/(R2+T2)$$

$$I3' = V/R3' = V\{2/(R1+T1)+2/(R2+T2)\}.$$

Referring to FIG. 20(*b*), there is the following relationship between the overall impedance R4' of the test image G4 and the total amount of electrical current I4', which flows through the test image G4 when the constant voltage V is applied:

$$R4' = 1/\{1/(R2+T1)+1/(R1+T2)+1/(R1+T2)+1/(R2+T1)\}$$

$$= 1/\{2/(R2+T1)+2/(R1+T2)$$

$$I4' = V/R4' = V\{2/(R2+T1)+2/(R1+T2)\}.$$

The amount of the difference ΔI between the amount of the transfer current which flows when the test image G3 is used, and the amount of the transfer current which flows when the test image G4 is used can be obtained from the following equation:

$$\Delta I = I4' - I3' = 2V(\{1/(R2+T1)+1/(R1+T2)-1/(R1+T1)-1/(R2+T2)\} \quad (5).$$

Because of the difference between the solid white portion and solid black portion, T1≠T2. After the operation in which multiple copies were continuously made, the primary transfer roller 5 is nonuniform in electrical resistance. Therefore, R1≠R2. Therefore, the transfer current difference is not zero: ΔI≠0. Therefore, the control portion 110 can accurately evaluate the lengthwise nonuniformity, in electrical resistance, of the primary transfer roller 5, by measuring the amount of difference ΔI obtained using the test images G3 and G4, as it was capable in the first embodiment, using the test images G1 and G2.

The lengthwise nonuniformity, in electrical resistance, of the primary transfer roller 5 was evaluated for every two hundred copies, using the test images G3 and G4.

After the production of 30,000 copies of the test image G3, the constant voltage was set to +1,985 V by the ATVC sequence. Then, the amount of the transfer current I3' was measured by making a toner image of the test image G3, and the amount of the transfer current I4' was measured by making a toner image of the test image G4.

The difference ΔI between the amount of the transfer current I4' and the amount of the transfer current I3' was 4.0 μA. Then, the density of the current which flowed through the portion of the transfer portion S1, which corresponds to the solid black portion of the test image G3, and the density of the current which flowed through the portion of the transfer portion S1, which corresponds to the solid black portion of the test image G4 were calculated using the same procedure as was used in the first embodiment. The amount of the current which flowed through the portion of the transfer portion S1, which corresponded to the solid black portion of the test image G3 was 2.6 μA/cm. However, the amount of transfer current which flowed through the transfer portion S1, which corresponded to the solid black portion of the test image G4 was 2.14 μA/cm, which was insufficient.

Thus, the control portion 110 stopped the image forming operation after the completion of roughly 30,000 copies. Then, it displayed the message that prompts a user to replace the primary transfer roller 5.

Embodiment 3

FIG. 22 is a drawing of the test images in the third embodiment.

Except for a part of the control sequence for evaluating the lengthwise nonuniformity, in electrical resistance, of the primary transfer roller 5, the third embodiment is the same as the first embodiment.

Referring to FIG. 22, as well as to FIG. 1, the control portion 110 evaluates the lengthwise nonuniformity, in electrical resistance, of the primary transfer roller 5 using four different test images G5*a*, G5*b*, G5*c*, and G5*d*. The four test images G5*a*, G5*b*, G5*c*, and G5*d* are the same in size, and are made up of a combination of a solid black portion and a solid white portion, or a combination of a solid black portion and two solid white portions. In terms of the lengthwise direction of the test images, the solid black portion of each test image G occupies ¼ of the test image. The four test images are different in the position of the solid black portion in terms of the lengthwise direction of the test image; as seen from the direction perpendicular to the lengthwise direction of the transfer roller, the four solid black portions are staggered from the adjacent ones by a length equal to the length of each solid black portion.

After the completion of the ATVC sequence, and adjustment of the image forming apparatus in the density level, the control portion 110 measures the amount of the transfer current I5*a*, the amount of the transfer current I5*b*, the amount of the transfer current I5*c*, and the amount of the transfer current I5*d*, by making a toner image of the test images G5*a*, a toner image of the test images G5*b*, a toner image of the test images G5*c*, and a toner image of the test images G5*d*.

If the transfer currents I5*a*, I5*b*, I5*c*, and I5*d* are the same in value, the control portion 110 determines that the primary transfer roller 5 is not nonuniform in electrical resistance in terms of its lengthwise direction. The test images G5*a*, G5*b*, G5*c*, and G5*d* are the same in electrical resistance value. Therefore, as long as the primary transfer roller 5 is not nonuniform in electrical resistance in its lengthwise direction, the transfer currents I5*a*, I5*b*, I5*c*, and I5*d* are equal in value.

However, when the transfer currents I5*a*, I5*b*, I5*c*, and I5*d* are not equal in value, the control portion 110 calculates the difference ΔI between the highest transfer current value and lowest transfer current value, and compares the amount of the difference ΔI with a preset threshold value β. Then, if ΔI>β, the control portion 110 stops the image forming operation, and displays the message that prompts a user to replace the primary transfer roller 5.

Embodiment 4

Figure 23:
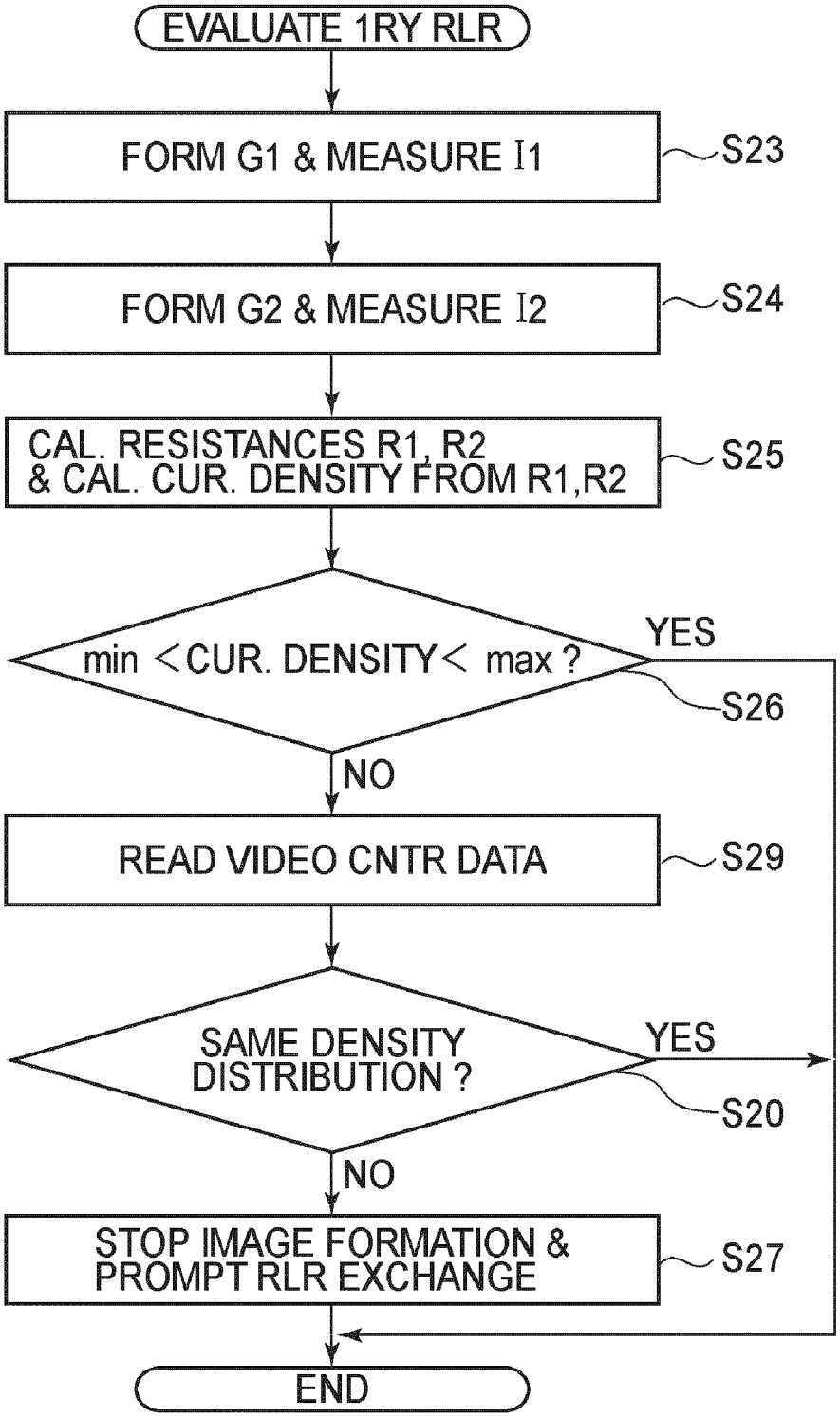
FIG. 23 is a flowchart of the operational sequence for evaluating the primary transfer roller in the fourth embodiment, in terms of its nonuniformity in electrical resistance.

FIG. 23 is a flowchart of the control sequence, in the fourth embodiment, for evaluating the nonuniformity, in electrical resistance, of the primary transfer roller 5.

Except for a part of the control sequence for evaluating the lengthwise nonuniformity, in electrical resistance, of the primary transfer roller 5, the fourth embodiment is the same as the first embodiment. Thus, the structural components and portions thereof, the portions of images, the control sequence steps, etc., in FIG. 23, which are the same as the counterparts in FIG. 8, are given the same referential symbols as those given to the counterparts in the FIG. 8, one for one, and will not be described again, to avoid repeating the same description.

Referring to FIG. 23, as well as to FIG. 1, the control portion 110 forms a toner image of the test image G1 on the photosensitive drum 1, and measures the amount of the transfer current I1 (S23). Then, it forms a toner image of the test image G2 on the photosensitive drum 1, and measures the amount of the transfer current I2 (S24).

Then, the control portion 110 calculates the amount of the electrical resistance R1 and the amount of electrical resistance R2 from the transfer currents I1 and I2, respectively, and the value of the current density which corresponds to the solid black portion of the test image G1, and the value of the current density which corresponds to the solid black portion of the test image G2 (S25).

If both the value of the current density corresponding to the solid black portion of the test image G1 and the value of the current density corresponding to the solid black portion of the test image G2 are within the high transfer efficiency range (YES in S26), it permits the continuation of the rest of the interrupted image forming operation.

However, if at least one of the value of the transfer current density, which corresponds to the solid black portion of the test image G1, and the value of the transfer current density, which corresponds to the solid black portion of the test image G2, is outside the high transfer efficiency range (NO in S26), the control portion 110 reads the data regarding the density distribution of the images to be formed thereafter, using the video counter 104.

Then, if the obtained density distribution is identical to the density distribution of the image which was being formed before the ATVC sequence was carried out the last time (YES in S29), the control portion 110 permits the continuation of the rest of the interrupted image forming operation. However, if the former is not identical to the latter, the control portion 110 interrupts or prohibits the continuation of the image forming operation, and displays the message that prompts a user to replace the secondary transfer roller 11.

In the first embodiment, when the evaluation of the lengthwise nonuniformity in electrical resistance of the primary transfer roller 5 revealed that the nonuniformity in electrical resistance of the primary transfer roller 5 is outside the tolerable range, the control portion 110 unconditionally prohibited the continuation of the interrupted image forming operation.

However, in the case when multiple copies of the test image G1 have been continuously made, even if the nonuniformity, in electrical resistance, of the primary transfer roller 5 is outside the tolerable range, the unsatisfactory transfer is unlikely to occur, as long as it is the formation of a toner image of the test image G1 that is continued thereafter. That is, the unsatisfactory transfer is liable to occur when an image, for example, the test image G1, which has been copied, is switched to another image, for example, the test image G2, which is completely different in density distribution from the image which has been copied. That is, the switching of the image to be copied changes the transfer portion (S1) in the density distribution of the toner image to be transferred; the portion of the transfer portion, through which the solid white portion of the preceding toner image have been moved, is made to accommodate the portion of the solid black portion of the toner image of the new image to be copied. Thus, in this portion of the transfer portion, the higher impedance of the solid black portion adds to the electrical resistance of the corresponding portion of the primary transfer roller 5, which has been increased by continuously facing the solid white portion of the toner image of the preceding image to be copied. Thus, this portion of the transfer portion S1 becomes insufficient in the amount of transfer current, failing to satisfactorily transfer the toner particles.

That is, as long as the images to be continuously copied are the same in density distribution, the unsatisfactory transfer is unlikely to occur. In the fourth embodiment, therefore, the replacement of the primary transfer roller 5 is postponed until the next time the primary transfer roller 5 is evaluated in its lengthwise nonuniformity in electrical resistance. Therefore, the employment of this embodiment can reduce the image forming apparatus 100 in the length of downtime, slightly improving the image forming apparatus 100 in the availability factor.

In the first embodiment, after making roughly 30,000 copies, the image forming operation is interrupted (stopped) if the value which shows the extent of the lengthwise nonuniformity, in electrical resistance, of the primary transfer roller 5 becomes greater than the values in the tolerable range. This setup is intended to prevent unsatisfactory transfer, which is likely to occur when an image forming operation, which is being carried out to make a large number of copies of the same image is interrupted to carry out another image forming operation to form a copy or copies of another image, which is significantly different in density distribution. Even after the portion of the transfer portion S1, which corresponded to the solid white portion of the toner image, fell in transfer current density below 2.14 μA/cm (bottom limit) because the portion of the primary transfer roller 5, which corresponded to the solid white portion of the toner image, increased in its electrical resistance R2, the portion of the transfer portion S1, in which the solid black portions of the toner image were continuously transferred was 2.60 μA/cm in current density, which is in the tolerable range of 2.14 μA/cm-2.74 μA/cm.

Other Embodiments

Figure 24:
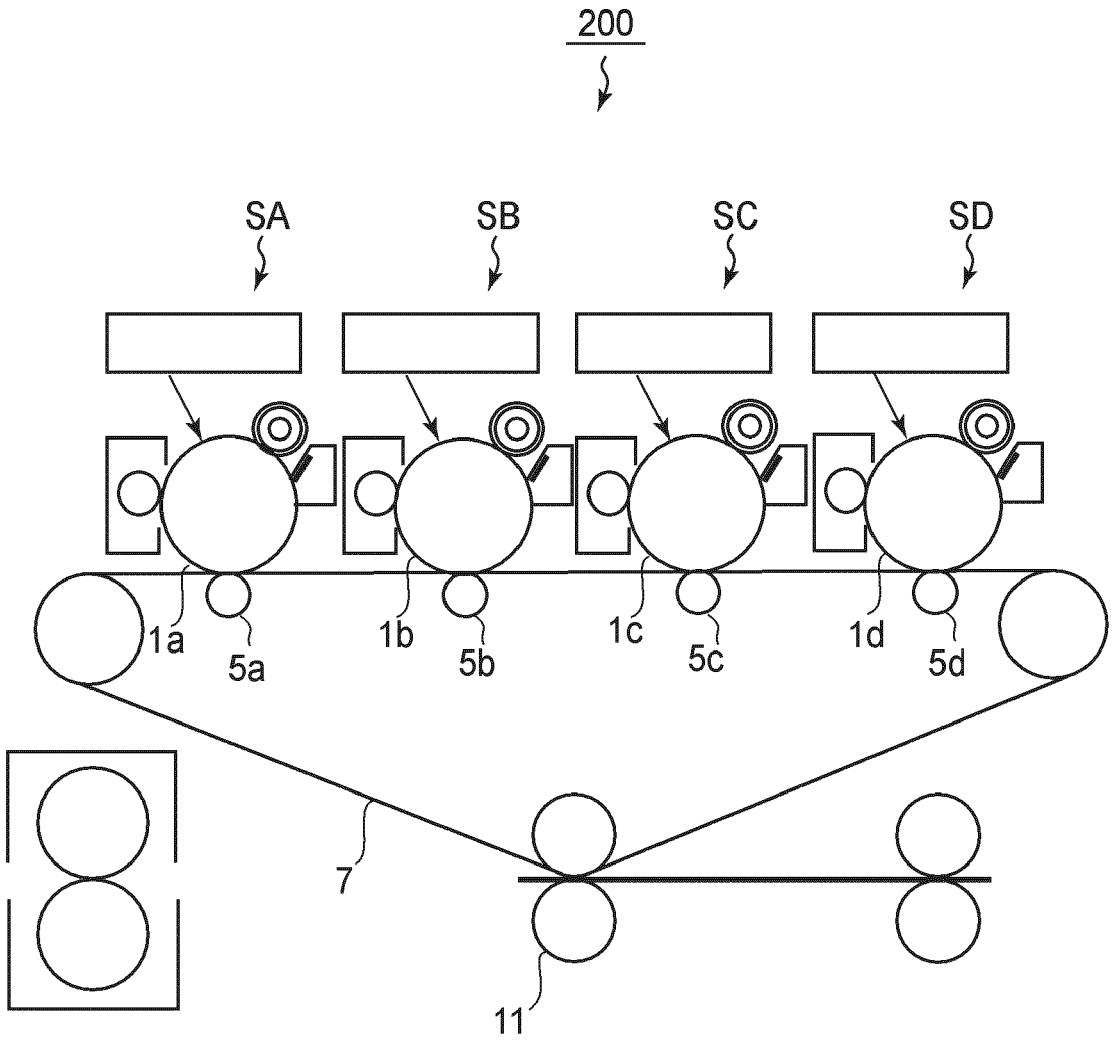
FIG. 24 is a schematic drawing of the image forming apparatus in the fifth embodiment of the present invention, showing the general structure of the apparatus.
Figure 25:
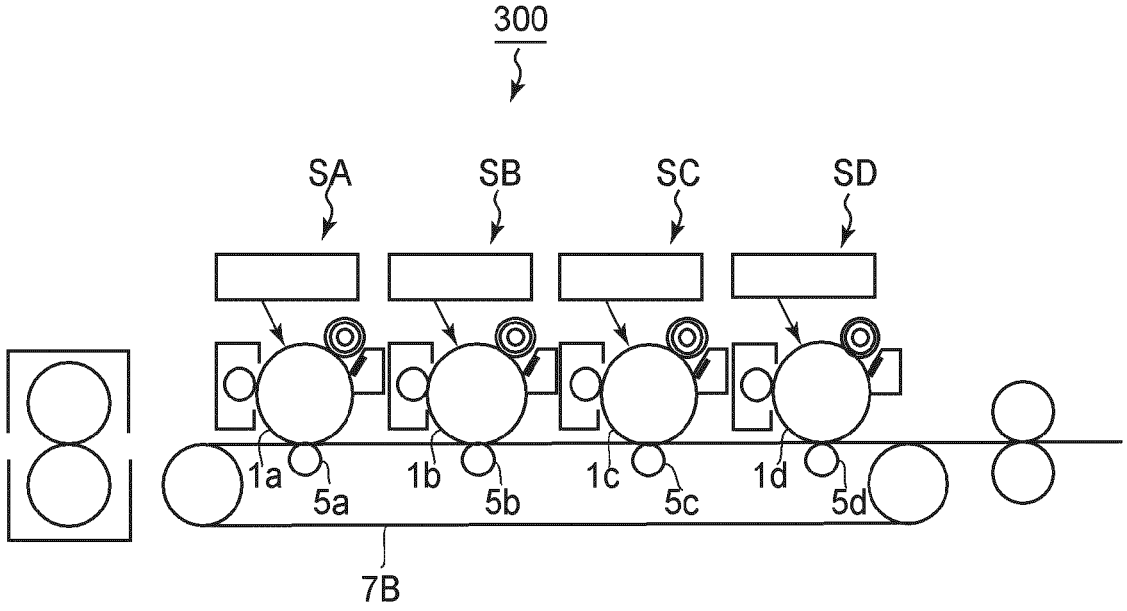
FIG. 25 is a schematic drawing of the image forming apparatus in the sixth embodiment of the present invention, showing the general structure of the apparatus.

FIG. 24 is a schematic drawing of the image forming apparatus in the fifth embodiment of the present invention, and shows the general structure of the apparatus. FIG. 25 is a schematic drawing of the image forming apparatus in the sixth embodiment, and shows the general structure of the apparatus.

Referring to FIG. 24, the image forming apparatus 200 is a full-color image forming apparatus which has an intermediary transfer belt 7, and yellow, magenta, cyan, and black image forming portions SA, SB, SC, and SD, respectively. The four image forming portions are juxtaposed in tandem, in the straight line along the horizontal portion of the loop which the intermediary transfer belt 7 forms. The image forming portions SA, SB, SC, and SD are roughly the same in structure, although they are different in the color of the toner with which their developing apparatus is filled.

The transfer rollers 5*a*, 5*b*, 5*c*, and 5*d* are kept pressed against the photosensitive drum 1*a*, 1*b*, 1*c*, and 1*d*, with the presence of the intermediary transfer belt 7 between the transfer rollers 5*a*, 5*b*, 5*c*, and 5*d* and photosensitive drum 1*a*, 1*b*, 1*c*, and 1*d*, respectively, forming four transfer portions. After four toner images are formed on the photosensitive drum 1*a*, 1*b*, 1*c*, and 1*d*, one for one, they are sequentially transferred in layers onto the intermediary transfer belt 7, and are conveyed by the intermediary transfer belt 7 to the nip between the intermediary transfer belt 7 and a secondary transfer roller 11, in which they are transferred together (secondary transfer) onto the recording medium.

The transfer rollers 5*a*, 5*b*, 5*c*, and 5*d* of the image forming apparatus 200, and the secondary transfer roller 11 of the image forming apparatus 200, can also be evaluated in their nonuniformity in electrical resistance, using an evaluation sequence similar to those in the first to fourth embodiments.

That is, they can be evaluated in their lengthwise nonuniformity in electrical resistance, at a satisfactory level of accuracy, simply by performing the above-described operation for adjusting the density level at which a toner image is formed, in conjunction with the ATVC sequence, that is, without the need for providing the image forming apparatus with an electrical resistance measuring apparatus dedicated to the measurement of the electrical resistance of the transfer rollers.

Referring to FIG. 25, the image forming apparatus 300 is a full-color image forming apparatus, which has a recording medium conveying belt 7B, and yellow, magenta, cyan, and black image forming portions SA, S B, SC, and SD, respectively. The four image forming portions are juxtaposed in tandem, in a straight line along the horizontal portion of the loop which the intermediary transfer belt 7B forms. The image forming portions SA, SB, SC, and SD are roughly the same in structure, although they are different in the color of the toner with which their developing apparatus is filled.

The transfer rollers 5*a*, 5*b*, 5*c*, and 5*d* are kept pressed against the photosensitive drum 1*a*, 1*b*, 1*c*, and 1*d*, with the presence of the intermediary transfer belt 7B between the transfer rollers 5*a*, 5*b*, 5*c*, and 5*d* and photosensitive drum 1*a*, 1*b*, 1*c*, and 1*d*, respectively, forming four transfer portions. After four toner images are formed on the photosensitive drum 1*a*, 1*b*, 1*c*, and 1*d*, one for one, they are sequentially transferred in layers onto the recording medium P, which is borne on the intermediary transfer belt 7 and is conveyed by the intermediary transfer belt 7B.

The transfer rollers 5*a*, 5*b*, 5*c*, and 5*d* of the image forming apparatus 300 can also be evaluated in their nonuniformity in electrical resistance, using an evaluation sequence similar to those in the first to fifth embodiments.

That is, they can be evaluated in their lengthwise nonuniformity in electrical resistance, at a satisfactory level of accuracy, simply by performing the above-described operation for adjusting the density level at which a toner image is formed, in conjunction with the ATVC sequence, that is, without the need for providing the image forming apparatus with an electrical resistance measuring apparatus dedicated to the measurement of the electrical resistance of the transfer rollers.

Incidentally, in the first to fifth embodiments, and miscellaneous embodiments, the test images were made up of one or more solid black portions Gb and one or more solid white portions. However, the preceding embodiments are not intended to limit the present invention in scope. That is, a test image has only to be nonuniform in the amount of toner deposition in terms of the direction parallel to the lengthwise direction of the transfer roller. For example, a test image may be made up of one or more solid black portions, which is 0.65 $mg/cm^2$ in the amount of toner deposition, and one or more solid halftone portions, which is 0.25 $mg/cm^2$ in the amount of toner deposition.

As will be evident from the above description of the preferred embodiments of the present invention, according to the present invention, the formation of an image suffering from defects attributable to the nonuniformity, in electrical resistance, of a transferring member, can be prevented, with the use of a simple method.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

a rotatable image bearing member;

toner image forming means for forming a toner image on said image bearing member, wherein said toner image forming means is capable of forming a toner image having a predetermined width measured in an axial direction of a rotational axis of said image bearing member at each of different positions;

a transfer member, pressed against said image bearing member, for forming a transfer portion for transferring the toner image onto the transfer material from said image bearing member;

a current detector for detecting a current flowing through the transfer member;

a calculating portion for calculating a resistance difference in said transfer member with respect to the axial direction, on the basis of outputs of said current detector for the toner images at the different positions when the toner images pass through the transfer portion; and an output portion for outputting an abnormality on the basis of an output of said calculating portion.

2. An apparatus according to claim 1, wherein said output portion outputs the abnormality when the output of said calculating portion indicates the difference exceeds a predetermined value.

3. An apparatus according to claim 1, wherein said transfer member includes a rotatable member, and wherein lengths, measured in a circumferential direction of said image bearing member, of the toner images having the predetermined width, are longer than a circumferential length of said rotatable member of said transfer member.

4. An apparatus according to claim 1, wherein the predetermined width is less than one half of a width, measured in the axial direction, of a range in which a toner image can be formed.

5. An apparatus according to claim 1, further comprising:

a reader configured to read a kind of the toner image, wherein said output portion outputs taking the kind of the toner image to be transferred by said transfer member into account after said calculating portion calculates the resistance difference.

6. An apparatus according to claim 1, wherein said output portion prohibits an image forming operation in response to the output of said calculating portion.

* * * * *